US006036565A

United States Patent [19]

Seko et al.

[11] Patent Number: 6,036,565

[45] Date of Patent: Mar. 14, 2000

[54] METHOD OF FABRICATING A FIELD EMMISION COLD CATHODE

[75] Inventors: Nobuya Seko; Yoshinori Tomihari, both of Tokyo, Japan

[73] Assignee: NEC Corporation, Japan

[21] Appl. No.: 08/846,153

[22] Filed: Apr. 25, 1997

[30] Foreign Application Priority Data

Apr. 26, 1996 [JP] Japan ..... 8-131135

[51] Int. Cl.[7] ..... H01J 9/02

[52] U.S. Cl. ..... 445/24; 445/50

[58] Field of Search ..... 445/24, 50

[56] References Cited

U.S. PATENT DOCUMENTS 5,628,661 5/1997 Kim et al. ..... 445/24
5,735,721 4/1998 Choi ..... 445/24

FOREIGN PATENT DOCUMENTS 49-79161 7/1974 Japan .
3-17933 1/1991 Japan .
6-131970 5/1994 Japan .
7-29484 1/1995 Japan .
7-122179 5/1995 Japan .

*Primary Examiner*—Kenneth J. Ramsey
*Attorney, Agent, or Firm*—Ostrolenk, Faber, Gerb & Soffen, LLP

[57] ABSTRACT

There is provided a method of fabricating a field emission cold cathode, including the steps, in sequence, of (a) forming a first insulating layer on a substrate and further forming a first electrode layer on first insulating layer, (b) forming at least one opening in first electrode layer, (c) forming a second insulating layer on first electrode layer and further forming a second electrode layer on second insulating layer, (d) forming at least one opening in second electrode layer, (e) optionally repeating steps (c) and (d) predetermined number of times, (f) forming a cavity extending from an uppermost electrode layer to substrate, (g) forming a first sacrifice layer around a first opening of a first electrode layer, (h) forming a second sacrifice layer around a second opening of a second electrode layer, and (i) forming an emitter electrode on substrate with first sacrifice layer being used as a mask. The method enables a field emission cold cathode including a focusing electrode to have small misalignment between an opening of a first opening of a first electrode layer and an emitter electrode to the same degree as that of a field emission cold cathode including no focusing electrode.

38 Claims, 17 Drawing Sheets

METHOD OF FABRICATING A FIELD EMMISION COLD CATHODE

BACKGROUND OF THE INVENTION

1. Field of the Invention

The invention relates to a method of fabricating a field emission cold cathode, and more particularly to a method of fabricating a field emission cold cathode capable of reducing a divergence angle of emitted electron beams.

2. Description of the Related Art

A field emission cold cathode attracts attention as a new electron source substituted for a hot cathode utilizing thermionic emission. A field emission cold cathode is provided with a so-called emitter electrode having a sharpened tip, and emits a mass of electrons when a high intensity field, specifically in the range of $2\times10^7$ V/cm to $5\times10^7$ V/cm or greater, is produced around the sharpened tip of the emitter electrode. Accordingly, performance of a device is greatly dependent on sharpness of the tip. It is said that a point of an emitter electrode is required to have a radius of curvature equal to or below hundreds of angstroms.

In order to produce an electric field, it is necessary that emitter electrodes are disposed with spacing between adjacent ones being about 1 $\mu$m or smaller, and that a voltage in the range of tens of to hundreds of volts is applied to emitter electrodes. In an actually used product, emitter electrodes in the range of thousands to tens of thousands in number are disposed on a common substrate.

Thus, a field emission cold cathode is fabricated in general by means of fine processing technology widely used in the semiconductor manufacturing field. A field emission cold cathode is applied to an electron tube such as a flat panel display, a micro vacuum tube, a micro-wave tube and a cathode ray tube (CRT), and an electron source for various sensors.

One of field emission cold cathodes is a so-called Spindt type field emission cold cathode, a perspective view of which is illustrated in FIG. 1. The illustrated Spindt type field emission cold cathode includes an electrically conductive substrate 51, a plurality of cone-shaped emitter electrodes 56 made of electrically conductive material and formed on the substrate 51, an insulating layer 52 formed with a plurality of cavities and formed on the substrate 51, and a gate electrode 53 formed with a plurality of openings each of which surrounds the emitter electrode 56.

As illustrated in FIG. 1, electron beams 59 emitted from the emitter electrodes 56 are divergent to some degree about a perpendicularly extending axis of the emitter electrodes 56. If each of the electron beams 59 emitted from each of the emitter electrodes 56 has divergence to a greater degree, all of the electron beams 59 emitted from an emitter array have greater divergence accordingly. For instance, when the illustrated emitter array is used for a flat panel display, the divergence of the electron beams 59 would cause excitation of fluorescent material by a picture element located adjacent, resulting in deterioration of crosstalk.

Japanese Unexamined Patent Publication No. 7-122179 has suggested a field emission cold cathode formed with a focusing electrode in order to depress divergence of electron beams. As illustrated in FIG. 2I, the suggested field emission cold cathode includes a substrate 61 including a substrate 61 consisting of a glass substrate 71, an electrically conductive layer 72 formed on the glass substrate 71 and a resistive layer 73 formed on the layer 72, a plurality of conical emitter electrodes 66 formed on the substrate 61, a first insulating layer 62 formed on the resistive layer 73, a gate electrode 63 formed on the first insulating layer 62 and formed with an opening surrounding a point of the emitter electrode 66, a second insulating layer 64 formed on the gate electrode layer 63, and a focusing electrode 65 formed on the second insulating layer 64 formed with an opening in alignment with the opening formed with the gate electrode 63. A lower voltage than a voltage to be applied to the gate electrode 63 is applied to the focusing electrode 65 to thereby converge electron beams emitted from the emitter electrodes 66.

A method of fabricating the above mentioned field emission cold cathode is explained hereinbelow with reference to FIGS. 2A to 2I.

First, as illustrated in FIG. 2A, the electrically conductive layer 72 and the resistive layer 73 are deposited on the glass substrate 71. Then, a silicon dioxide ($SiO_2$) film as the first insulating layer 62 and a niobium (Nb) film as the gate electrode 63 are formed on the resistive layer 73.

Then, as illustrated in FIG. 2B, an aluminum layer as a mask layer 68 is deposited over the gate electrode 63. Then, a first resist layer 75 patterned by photolithography is formed on the mask layer 68, as illustrated in FIG. 2C. The mask layer 68 is etched with the first resist layer 75 being used as a mask to thereby form a ring-shaped mask layer 69, as illustrated in FIG. 2D.

Then, the second insulating layer 64 and the focusing electrode 65 are deposited over a resultant, as illustrated in FIG. 2E.

Then, a second resist layer 76 is formed over a resultant, and is patterned by lithography so that the layer 76 has an opening having a diameter equal to an outer diameter S of the ring-shaped mask 69. Then, reactive ion etching (RIE) is carried out with the patterned second resist layer 76 being used as a mask to thereby etch the focusing electrode 65 and the second insulating layer 64. As a result, there is formed a first opening 78 in which the ring-shaped mask 69 and the gate electrode 63 appear, as illustrated in FIG. 2F.

Then, the niobium film or the gate electrode 63 is dry-etched with $SF_6$ and the silicon dioxide film or the first insulating layer 62 are dry-etched with $CHF_3$ both with the ring-shaped mask 69 being used as a mask, to thereby form a second opening 79 in the gate electrode 63 and the first insulating layer 62, as illustrated in FIG. 2G.

Then, as illustrated in FIG. 2H, there is carried out oblique evaporation with the resultant being rotated, to thereby form a sacrifice layer 77 on the second resist layer 76 and further on an inner sidewall of the first opening 78 so that an opening area of the first opening 78 is almost equal to an opening area of the second opening 79. Herein, the sacrifice layer 77 is made of metal such as nickel (Ni) and aluminum (Al).

Then, molybdenum (Mo) is evaporated perpendicularly onto the resistive layer 73. Since molybdenum particles for deposition are masked by an opening 77*a* defined by the sacrifice layer 77 formed around the first opening 78, the molybdenum particles are deposited on the resistive layer 73 as if a shape of the opening 77*a* is projected onto the resistive layer 73. The molybdenum particles deposit also on the sacrifice layer 77 to thereby form a molybdenum layer 67. Hence, with the deposition of the molybdenum particles on the sacrifice layer 77, a diameter of the opening 77*a* of the sacrifice layer 77 is gradually decreased. Accordingly, a diameter of the deposition of the molybdenum particles on the resistive layer 73 is gradually decreased, resulting in that a conical emitter electrode 66 is formed, as illustrated in FIG. 2H.

Then, a resultant is soaked into phosphoric acid to thereby remove the molybdenum layer 67, the sacrifice layer 77 and the second resist layer 76. Thus, there is completed a field emission cold cathode 70 as illustrated in FIG. 2I.

As illustrated in FIG. 3, the ring-shaped mask 69 may be designed to have a greater outer diameter than an inner diameter of the first opening 78. According to the above mentioned Publication No. 7-122179, this structure brings an advantage that an accuracy in registration for the formation of the first opening 78 may be decreased.

One of field emission cold cathodes having no focusing electrode is suggested in Japanese Patent Application No. 7-60886, which does not constitute a prior art, but is described hereinbelow for better understanding of the present invention. As illustrated in FIG. 4A, the suggested field emission cold cathode includes a substrate 101, a first insulating layer 104 formed on the substrate 101, a second insulating layer 105 formed on the first insulating layer 104, a gate electrode 103 formed on the second insulating layer 105, and an emitter electrode 106 formed on the substrate 101. The illustrated cold cathode is characterized by double insulating layers formed with openings having different inner diameters.

The formation of the two insulating layers with openings having different inner diameters improves insulation performance between the substrate 101 and the gate electrode 103. In the field emission cold cathode illustrated in FIG. 4A, a diameter Dg of an opening formed with the gate electrode 103 is equal to a diameter Di of an opening formed with the second insulating layer 105. However, as illustrated in FIG. 4B, the diameter Dg may be designed to be greater than the diameter Di (Dg>Di).

Japanese Unexamined Patent Publication No. 6-131970 has suggested a method of forming an emitter electrode including steps of forming two sacrifice layers. Hereinbelow is explained the suggested method.

As illustrated in FIG. 5A, an oxide film 82, a tungsten film 83 and a first sacrifice layer 91 are formed on a substrate 81. Then, a resist layer 89 is formed over the first sacrifice layer 91, and is patterned. Then, the first sacrifice layer 91 is formed with an opening by etching with the patterned resist layer 89 being used as a mask.

After the removal of the resist layer 89, a second sacrifice layer 92 is deposited all over a resultant, as illustrated in FIG. 5B. Then, the second sacrifice layer 92 is formed with an opening, and thereafter a cavity is formed in the tungsten layer 83 and the oxide layer 82. Then, molybdenum particles are evaporated onto the substrate 81 to thereby form a small emitter electrode 86, as illustrated, in FIG. 5C. At the same time, a molybdenum layer 86*a* is formed over the second sacrifice layer 92.

The second sacrifice layer 92 is etched in selective areas to thereby remove or lift-off the molybdenum layer 86a deposited thereon. Then, molybdenum particles are evaporated onto the small emitter electrode 86 with the first sacrifice layer 91 being used as a mask, to thereby make the emitter electrode 86 grow, as illustrated in FIG. 5D. Then, the first sacrifice layer 91 together with a molybdenum layer deposited on the first sacrifice layer 91 are etched for lift-off. Thus, there is completed a field emission cold cathode 90, as illustrated in FIG. 5E.

The above mentioned conventional field emission cold cathode including a focusing electrode described with reference to FIGS. 2A to 2I, suggested in Japanese Unexamined Patent Publication No. 7-122179, has problems as follows.

The first problem is that an emitter electrode is formed in inclination if it is to be formed near an outer edge of the substrate, and that an emitter electrode is formed in no alignment with an opening formed with a gate electrode. The reason is explained hereinbelow with reference to FIGS. 6A and 6B.

A substrate 1 and an evaporation source 2 are positioned as illustrated in FIG. 6A when a film is formed by vacuum evaporation process. Particles for deposition are emitted perpendicularly onto a central region of the substrate 1, namely particles are emitted with an incident angle perpendicular to the substrate, and particles for deposition are emitted with a smaller incident angle onto a region further away from the central region of the substrate. Particles for deposition are emitted onto an outer edge of the substrate 1 with an incident angle θ.

FIG. 6B is a cross-sectional view of a portion near the outer edge of the substrate 1. As illustrated, the sacrifice layer 77 formed on the electrode layer 5 acts as a mask for the formation of the emitter electrode 6. However, the sacrifice layer 77 acting as a mask is located at a distance from the substrate on which the emitter electrode 6 is to be formed. In addition, the particles for deposition have an almost parallel laminar flow at the central region of the substrate 1, but arrive at portions near the outer edge of the substrate 1 with an incident angle θ. Hence, compared to a field emission cold cathode having no focusing electrode in which the emitter electrode is formed by using a sacrifice layer as a mask which sacrifice layer is formed with an opening and formed on the gate electrode, a summit of the emitter electrode is made eccentric to a greater degree to the opening formed with the gate electrode, and the emitter electrode is formed in greater inclination for the same incident angle θ, because the sacrifice layer acting as a mask is located further away from the substrate on which the emitter electrode is to be formed.

The second problem is large dispersion in shape of emitter electrodes. According to the above mentioned Publication No. 7-122179, as illustrated in FIG. 2H, this is because a diameter of an opening of the focusing electrode 65 is designed to be 1.2–2.0 times greater than a diameter of an opening of the gate electrode 63, and the sacrifice layer 77 formed around an opening of the focusing electrode 65 is used as a mask for the formation of the emitter electrode 66. That is, in the conventional method, it is necessary to deposit a large amount of sacrifice layer material on the focusing electrode 65 in order to equalize a diameter of a large opening of the focusing electrode 65 to a diameter of a small opening of the gate electrode 63.

The sacrifice layer 77 is formed by oblique evaporation with the substrate 71 being rotated. An opening formed in the sacrifice layer 77 deposited on the second resist layer 76 is initially circular, however, as a thickness of the sacrifice layer 77 is increased, the opening includes much deformation in shape. Accordingly, such deformation in shape of the opening causes a shape of the emitter electrode 66 to be deformed, because the deformed shape of the opening is projected to a shape of the emitter electrode 66. Thus, large dispersion in shape is found in a plurality of emitter electrodes.

The third problem is low designability both in a diameter of an opening of the focusing electrode 65 and a distance from the gate electrode 63 to the focusing electrode 65 which distance is equal to a thickness of the second insulating layer 64. These are important factors for depressing the divergence of electron beams. The reasons for the above mentioned low designability are that if an opening of the focusing electrode 65 is designed to have a greater diameter, the sacrifice layer 77 has to have a greater thickness, resulting in difficulty in obtaining proper shape of an emitter electrode, and that if the second insulating layer 64 is designed to have a greater thickness, as mentioned with reference to the first problem, it would be difficult for all of the emitter electrodes 66, in particular, emitter electrodes located near an outer edge of the substrate 71, to have a common shape.

The fourth problem is that the emitter electrodes are formed in misalignment with an opening of the gate electrode all over the substrate. The reason is as follows. In the conventional method, openings of the gate electrode and the focusing electrode are positioned relative to each other by means of two photolithography steps, and hence it is not possible to completely avoid misalignment in photolithography. As a result, when an emitter electrode is formed in an opening of the gate electrode with the focusing electrode having an opening being used as a mask, the emitter electrode is formed in accordance with the misalignment.

The fifth problem is difficulty in selecting material of which the ringshaped mask 69 is made. In the embodiment described in the above mentioned Publication No. 7-122179, the ring-shaped mask 69 is made of aluminum, and phosphoric acid is used for lift-off. However, aluminum is etched by phosphoric acid during carrying out lift-off. If aluminum of which the ring-shaped mask 69 is made is etched, durability and/or reliability of a device is deteriorated in particular in a device where, as illustrated in FIG. 3, the ring-shaped mask 69 is designed to have a greater outer diameter than an inner diameter of an opening of the focusing electrode.

The sixth problem is deposition of emitter material onto an opening of the gate electrode. In the above mentioned Publication No. 7-122179, after an area of an opening of the sacrifice layer 77 formed on the focusing electrode 65 is almost equalized to that an area of an opening of the gate electrode 63, emitter material is deposited to thereby form the emitter electrode 66 on the substrate. However, particles of emitter material may deposit to an opening of the gate electrode 63 on which no sacrifice layer is formed, due to deformation in an opening, dispersion in shape in openings, and inaccuracy in an incident angle of evaporation particles as set forth in the first problem. Hence, some evaporation particles cannot be removed even by lift-off.

Similarly, in a field emission cold cathode illustrated in FIG. 4B which has no focusing electrode, but has two-layered insulating layers, emitter material may deposit to a projecting end portion of the second insulating layer 105, and cannot be removed even by lift-off.

In the conventional method suggested in the above mentioned Japanese Unexamined Patent Publication No. 6-131970, the first and second sacrifice layers 91 and 92 are deposited one on another, and thereafter openings are formed by etching in the first and second sacrifice layers 91 and 92, as illustrated in FIG. 5A. The first and second sacrifice layers 91 and 92 are used as a mask for the formation of the emitter electrode 86. The process suggested in the above mentioned Publication has to repeat evaporation of emitter material and lift-off twice. Hence, in order to accomplish the process, the second sacrifice layer 92 has to be selectively removable against the first sacrifice layer 91.

Thus, there have to be carried out two steps separately, one for removing the first sacrifice layer 91, and the other for removing the second insulating layer 92. This would take much time, and make the process more complicated. In addition, the second sacrifice layer 92 has to be made of different material from the first sacrifice layer 91, which would decrease designability and increase the fabrication costs.

SUMMARY OF THE INVENTION

In view of the foregoing problems of the prior methods, it is an object of the present invention to provide a method of fabricating a field emission cold cathode which method is capable of providing sufficient designability in both a diameter of an opening of a focusing electrode and a distance from a gate electrode to a focusing electrode, and greater accuracy with which emitter electrodes are formed.

There is provided a method of fabricating a field emission cold cathode, including the steps, in sequence, of (a) forming a first insulating layer on a substrate and further forming a first electrode layer on the first insulating layer, (b) forming at least one opening in the first electrode layer, (c) forming a second insulating layer on the first electrode layer and further forming a second electrode layer on the second insulating layer, (d) forming at least one opening in the second electrode layer, (e) repeating the steps (c) and (d) predetermined number of times, (f) forming a cavity extending from an uppermost electrode layer to the substrate, and (g) forming an emitter electrode on the substrate in the first insulating and electrode layers.

The cavity is formed in the step (f) preferably by etching the insulating layers with the electrode layers lying on the insulating layers being used as masks. It is preferable that an opening formed in an electrode layer has a larger area than an area of an opening formed in electrode layers located therebelow.

There is further provided a method of fabricating a field emission cold cathode, including the steps, in sequence, of (a) forming a first insulating layer on a substrate and further forming a first electrode layer on the first insulating layer, (b) forming at least one opening in the first electrode layer, (c) forming a second insulating layer on the first electrode layer and further forming a second electrode layer on the second insulating layer, (d) forming at least one opening in the second electrode layer, (e) repeating the steps (c) and (d) predetermined number of times, (f) forming a cavity extending from an uppermost electrode layer to the substrate, (g) forming a first sacrifice layer around an opening of one of the electrode layers, and (h) forming an emitter electrode on the substrate with the first sacrifice layer being used as a mask, It is preferable that the first sacrifice layer is formed around an opening of the first electrode layer. When the cavity is formed in the step (f), it is preferable that the electrode layers are etched with reactive ion etching (RIE) and the insulating layers are etched with buffered hydrofluoric acid (BHF).

The first sacrifice layer is formed in the step (g) by oblique evaporation of source material. An incident angle of the source material to be deposited around the opening may be defined so that evaporation of source material is not interrupted by edges of an opening formed in an uppermost layer and source material deposits around an opening formed at an electrode layer.

There is still further provided a method of fabricating a field emission cold cathode, including the steps, in sequence, of (a) forming a first insulating layer on a substrate and further forming a first electrode layer on the first insulating layer, (b) forming at least one opening in the first electrode layer, (c) forming a second insulating layer on the first electrode layer and further forming a second electrode layer on the second insulating layer, (d) forming at least one opening in the second electrode layer, (e) repeating the steps (c) and (d) a predetermined number of times, (f) forming a cavity extending from an uppermost electrode layer to the substrate, (g) forming a first sacrifice layer around a first opening of a first electrode layer, (h) forming a second sacrifice layer around a second opening of a second electrode layer, and (i) forming an emitter electrode on the substrate with the first sacrifice layer being used as a mask.

It is preferable that the first sacrifice layer is formed on an uppermost electrode layer. When the first sacrifice layer is formed by oblique evaporation of source material, the source material may be deposited with a first incident angle defined so that obliquely evaporated source material covers therewith an inner sidewall of an opening formed in the uppermost electrode layer. When the second sacrifice layer is formed by oblique evaporation of source material, the source material may be deposited with a second incident angle defined so that evaporation of source material is not interrupted by edges of an opening formed in an uppermost layer and source material deposits on an inner sidewall of an opening formed in an electrode layer located below the uppermost layer.

It is preferable that the second sacrifice layer has a greater density than a density of the first sacrifice layer. When the second sacrifice layer is formed by oblique evaporation of source material, the source material may be deposited with a second incident angle defined so that the second sacrifice layer covers the first sacrifice layer therewith.

The method may further include the step of a second sacrifice layer formed on the first sacrifice layer which is formed on an uppermost layer.

It is preferable that the first and second sacrifices layers are formed with different incident angles in oblique evaporation of source material. The incident angles for oblique evaporation of source material may be continuously varied. As an alternative, the incident angle may be increasing or decreasing from a first incident angle for forming the first sacrifice layer to a second incident angle for forming the second sacrifice layer. The incident angle may be varied reciprocatingly between first and second predetermined angles. The incident angles in oblique evaporation of source material may be varied in stages.

It is preferable for the second sacrifice layer to have a portion formed by oblique evaporation of source material with an incident angle of 70 degrees or greater with respect to an axis perpendicular to the substrate.

There is further provided a method of fabricating a field emission cold cathode, including the steps, in sequence, of (a) forming a first insulating layer on a substrate and further forming a first electrode layer on the first insulating layer, (b) forming at least one first opening in the first electrode layer, (c) forming a second insulating layer on the first electrode layer and further forming a second electrode layer on the second insulating layer, (d) forming at least one second opening in the second electrode layer, (e) repeating the steps (c) and (d) a predetermined number of times, (f) forming a cavity extending from an uppermost electrode layer to the substrate, (g) depositing a first sacrifice layer around the second opening with a greater incident angle, (h) depositing a second sacrifice layer around the first opening with a smaller incident angle, and (i) forming an emitter electrode on the substrate with the second sacrifice layer being used as a mask.

There is further provided a method of fabricating a field emission cold cathode, including the steps, in sequence, of (a) forming a first insulating layer on a substrate and further forming a second insulating layer on the first insulating layer, (b) forming an electrode layer on the second insulating layer, (c) forming a cavity through the electrode layer and the first and second insulating layers so that the second insulating layer projects inwardly of the cavity beyond the first insulating layer and the electrode layer, (d) forming a first sacrifice layer covering the electrode layer and a projecting portion of the second insulating layer therewith by depositing sacrifice layer material at a first angle, (e) forming a second sacrifice layer only above the electrode layer by depositing sacrifice layer material at a second angle, and (f) forming an emitter electrode on the substrate with the second sacrifice layer acting as a mask.

There may be formed one or more sacrifice layer(s) on the second sacrifice layers.

The above and other objects and advantageous features of the present invention will be made apparent from the following description made with reference to the accompanying drawings, in which like reference characters designate the same or similar parts throughout the drawings.

BRIEF DESCRIPTION OF THE DRAWINGS

FIGS. 7A to 7I are cross-sectional views of a field emission cold cathode, illustrating respective steps of a method of fabricating the same in accordance with the first embodiment of the present invention.

DESCRIPTION OF THE PREFERRED EMBODIMENTS

A method in accordance with the first embodiment of the present invention is explained hereinbelow with reference to FIGS. 7A to 7I.

Figure 1:
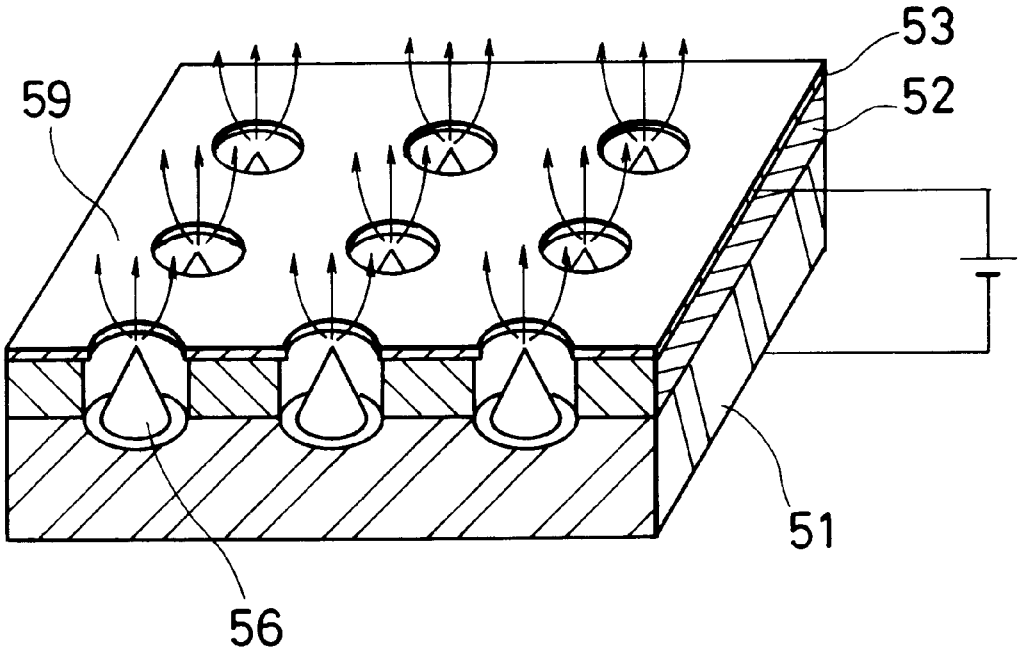
FIG.1 PRIOR ART
FIG. 1 is a perspective view illustrating a conventional Spindt type field emission cold cathode.
Figure 2A:
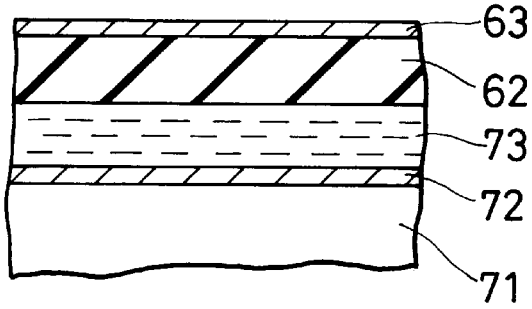
FIG. 2A PRIOR ART
FIGS. 2A to 2I are cross-sectional views of a field emission cold cathode having a focusing electrode, illustrating respective steps of a conventional method of fabricating the same.
Figure 2B:
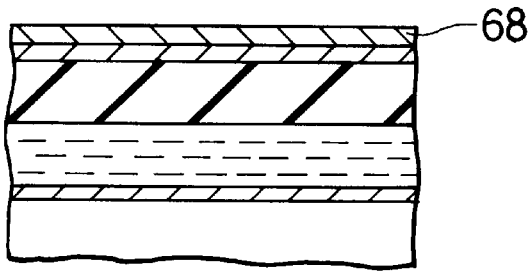
FIG. 2B PRIOR ART
Figure 2C:
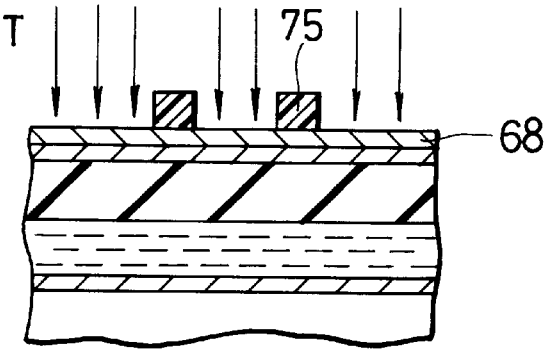
FIG. 2C PRIOR ART
Figure 2D:
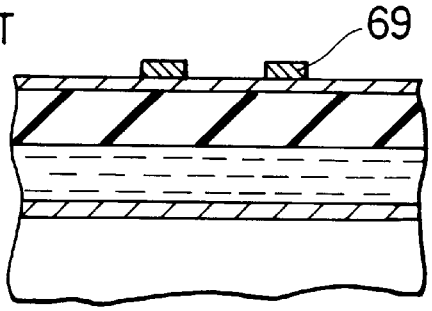
FIG. 2D PRIOR ART
Figure 2E:
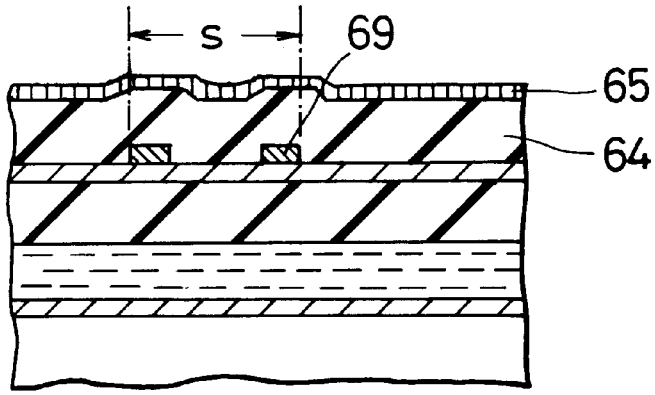
FIG.2E PRIOR ART
Figure 2F:
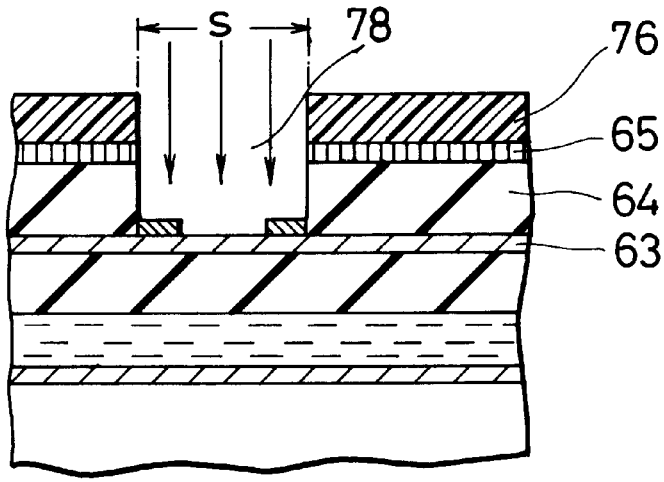
FIG.2F PRIOR ART
Figure 2G:
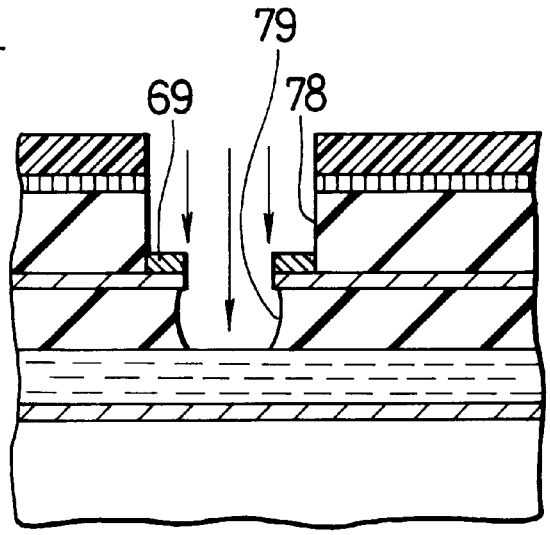
FIG.2G PRIOR ART
Figure 2H:
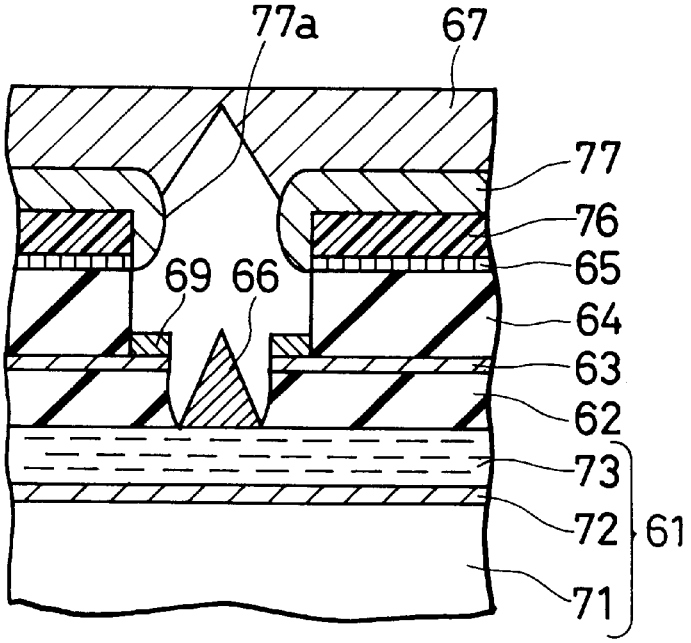
FIG. 2H PRIOR ART
Figure 2I:
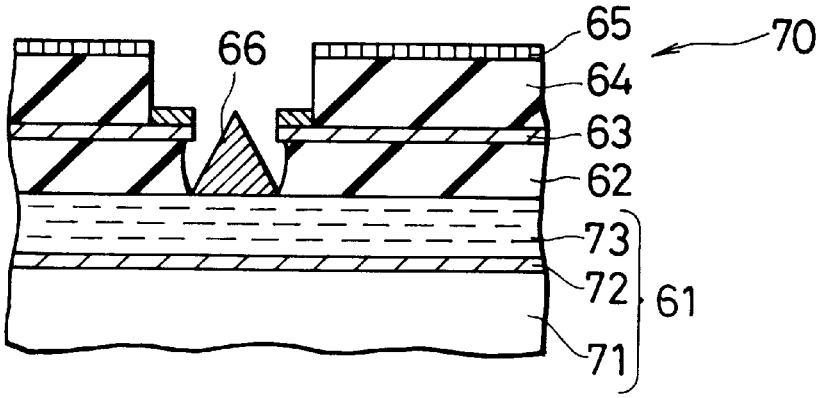
FIG. 2I PRIOR ART
Figure 3:
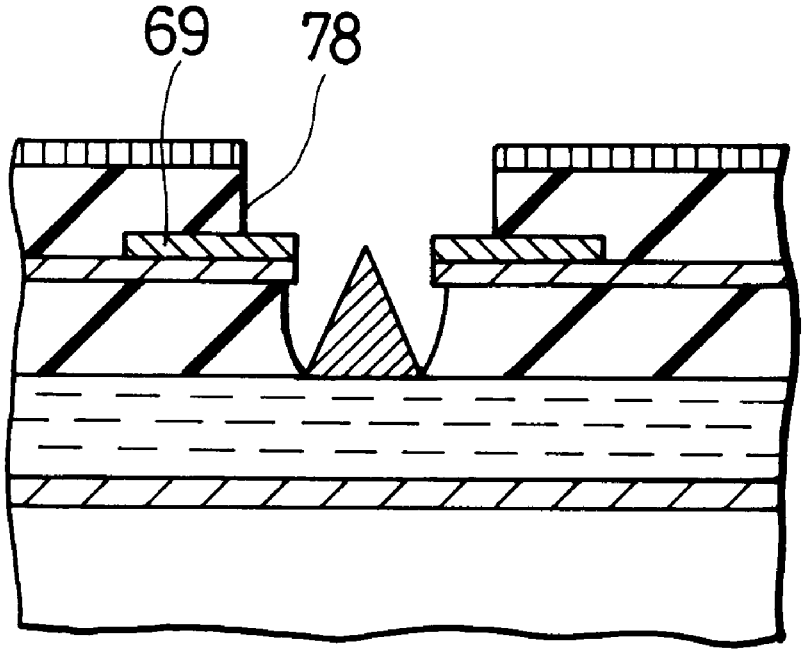
FIG. 3 PRIOR ART
FIG. 3 is a cross-sectional view of a conventional field emission cold cathode having a focusing electrode.
Figure 4A:
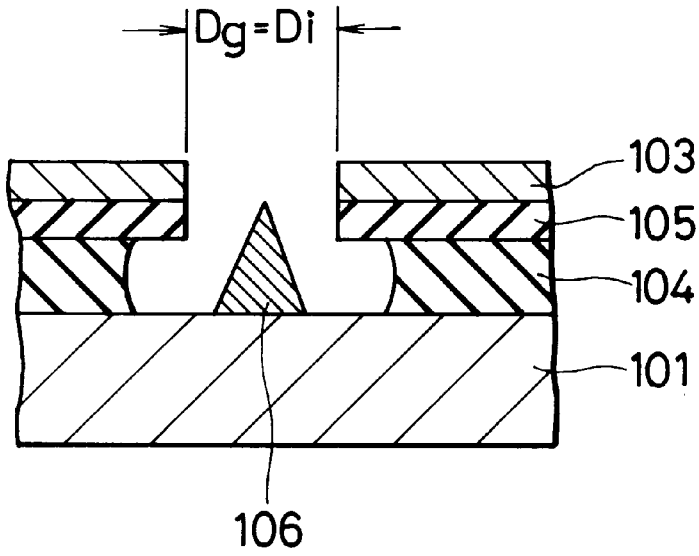
FIG.4A PRIOR ART
FIGS. 4A and to 4B are cross-sectional views of a conventional field emission cold cathode having no focusing electrode, but having two insulating layers.
Figure 4B:
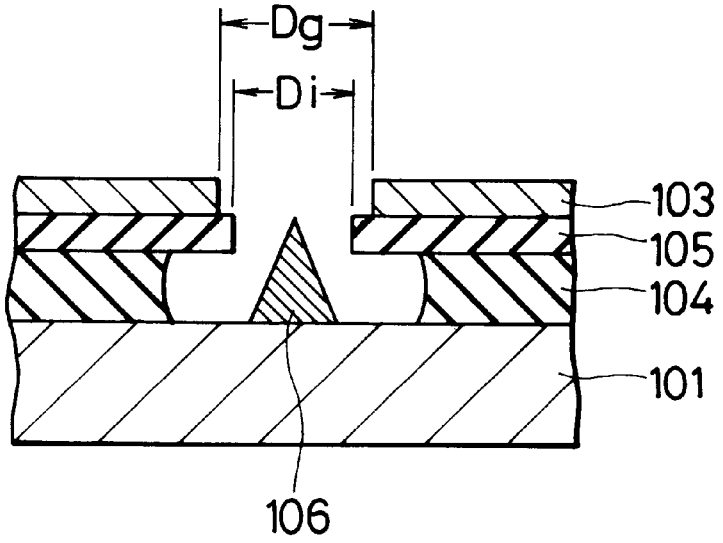
FIG.4B PRIOR ART
Figure 5A:
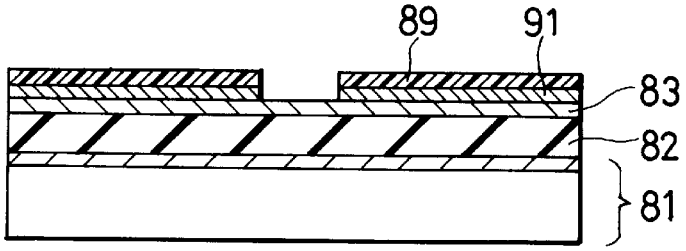
FIG.5A PRIOR ART
FIGS. 5A to 5E are cross-sectional views of a field emission cold cathode, illustrating respective steps of a conventional method of fabricating the same by using two sacrifice layers.
Figure 5B:
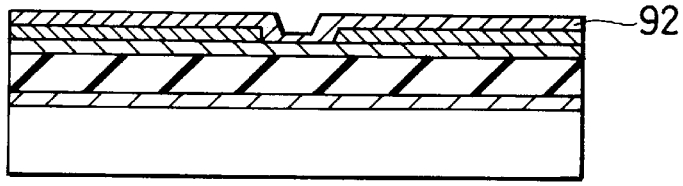
FIG.5B PRIOR ART
Figure 5C:
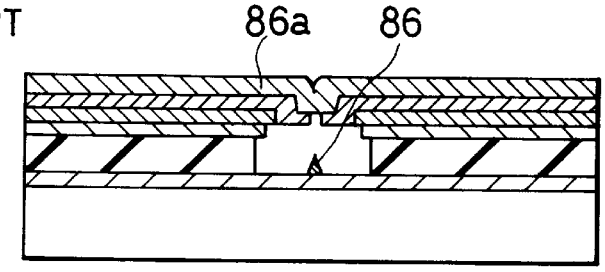
FIG.5C PRIOR ART
Figure 5D:
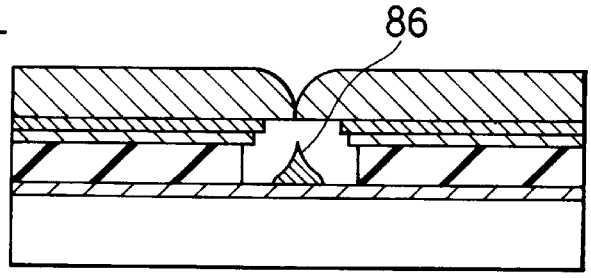
FIG.5D PRIOR ART
Figure 5E:
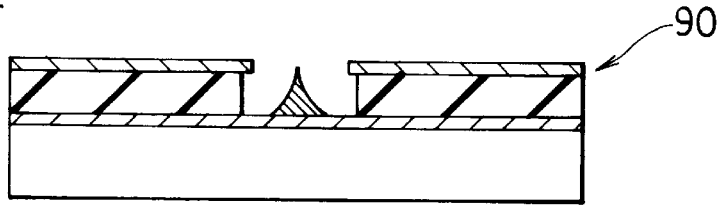
FIG.5E PRIOR ART
Figure 6A:
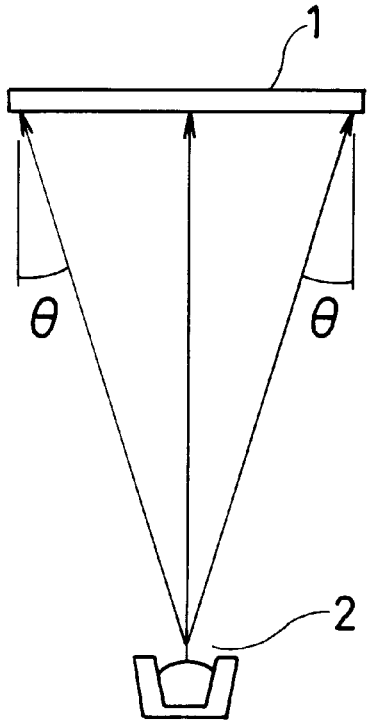
FIG.6A PRIOR ART
FIG. 6A is a schematic view illustrating relative positional relation between a substrate and a evaporation source.
Figure 6B:
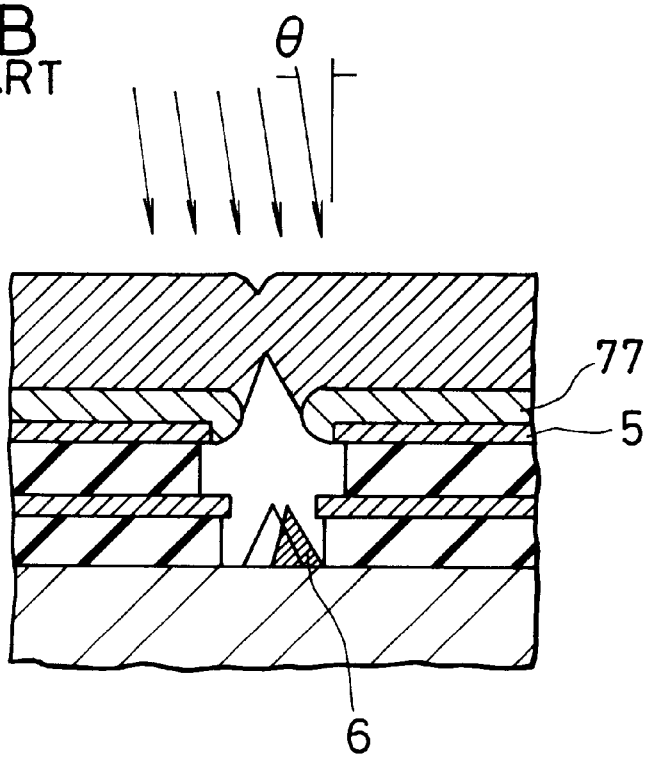
FIG.6B PRIOR ART
FIG. 6B is a cross-sectional view of a portion near an outer edge of a substrate illustrated in FIG. 6A.
Figure 7A:
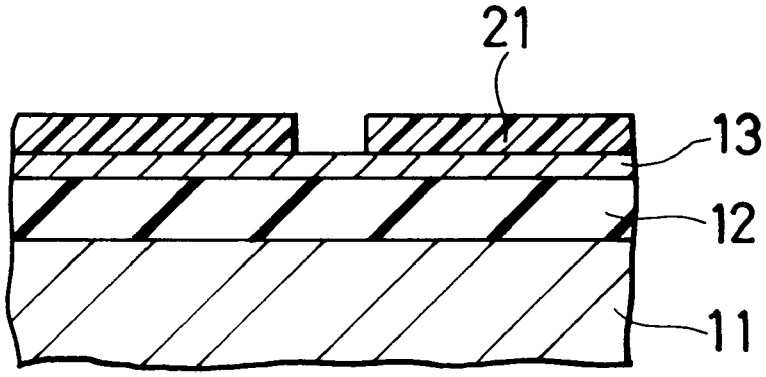

As illustrated in FIG. 7A, an oxide film 12 as the first insulating layer is formed on a silicon substrate 11 by an about 0.5 $\mu$m thickness. Then, a tungsten film as the electrically conductive gate electrode 13 is deposited over the oxide film 12 by an about 0.2 $\mu$m by sputtering. Then, a first photoresist layer 21 is deposited over the tungsten film 13, and is patterned by photolithography with a plurality of circular openings (only one of them is illustrated in FIG. 7A) each having a diameter of about 0.6 $\mu$m.

Figure 7B:
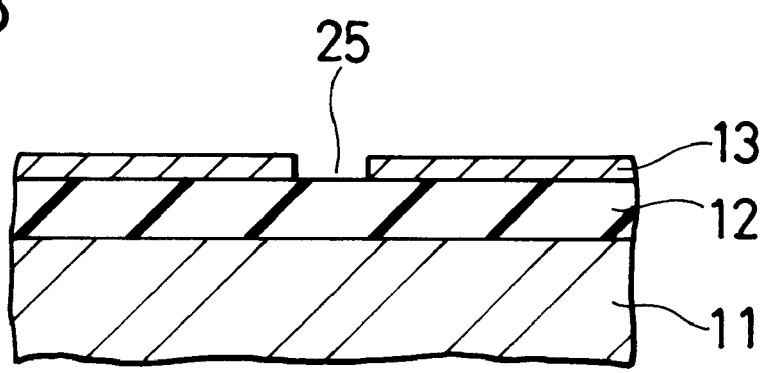

Then, the gate electrode 13 is etched with the first photoresist layer 21 being used as a mask by reactive ion etching (RIE) employing mixture gas including $SF_6$ and HBr gases, to thereby form an opening 25 in the gate electrode 13. Then, the first photoresist layer 21 is removed, as illustrated in FIG. 7B.

Figure 7C:
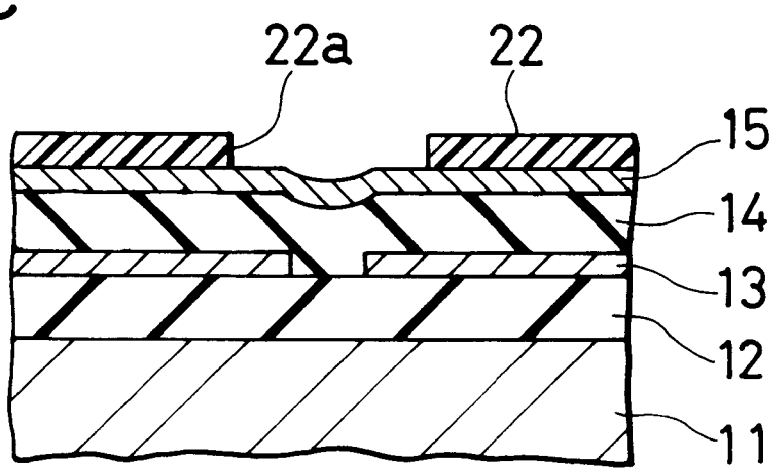

Then, a silicon dioxide ($SiO_2$) film 14 as the second insulating layer is formed by an about 0.5 $\mu$m thickness over a resultant by chemical vapor deposition (CVD). A tungsten film 15 as the electrically conductive focusing electrode is formed by an about 0.2 $\mu$m thickness on the silicon dioxide film 14 by sputtering. Then, a second photoresist layer 22 is deposited over the focusing electrode 15, and is patterned by photolithography so as to have an opening 22*a* having a diameter of about 1.6 $\mu$m in alignment with the gate opening 25, as illustrated in FIG. 7C.

Figure 7D:
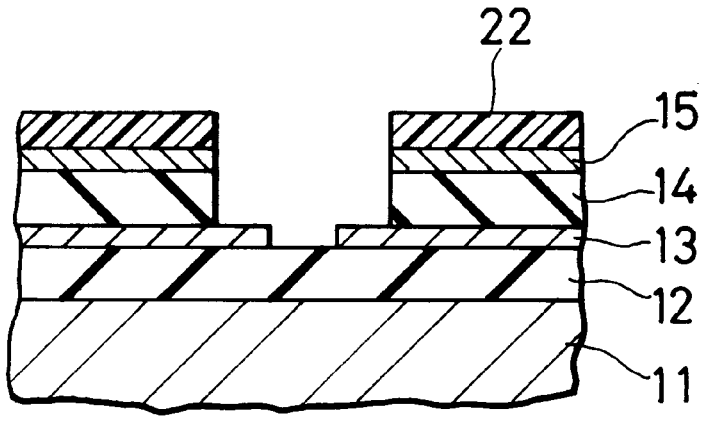

Then, the focusing electrode 15 is etched with the patterned second photoresist layer 22 being used as a mask by RIE employing mixture gas including $SF_6$ and HBr gases, and similarly the second insulating layer 14 is etched by RIE employing mixture gas including $CF_4$ and Ar gases, to thereby make the gate electrode 13 and the first insulating layer 12 appear, as illustrated in FIG. 7D.

Figure 7E:
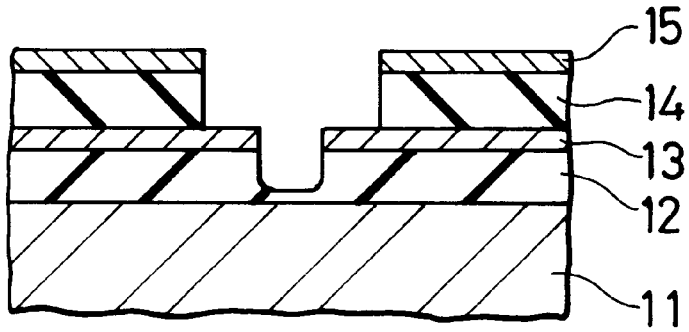
Figure 7F:
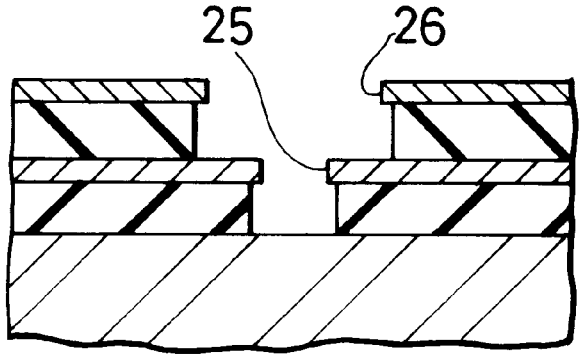

After removal of the second photoresist layer 22, the first insulating layer 12 is etched by RIE having selectivity to both the gate electrode 13 and the focusing electrode 15 and employing mixture gas including $CF_4$ and Ar gases so that the first insulating layer 12 remains only by an about 0.1 $\mu$m thickness, as illustrated in FIG. 7E. Thereafter, the first and second insulating layers 12 and 14 are further etched with buffered hydrofluoric acid (BHF) to thereby cause the gate electrode 13 and the focusing electrode 15 to horizontally project beyond the first and second insulating layers 12 and 14, respectively, as illustrated in FIG. 7F.

Thus, the combination of RIE and wet etching employing BHF avoids overetching to the silicon substrate 11.

When a mixture gas including $CF_4$ and Ar is used as the process gas, an etching selection ratio between silicon dioxide and tungsten is about 50:1, and hence there is not posed a problem about etching to surfaces of both the focusing electrode 15 and the gate electrode 13.

It is no longer necessary in the instant embodiment to use a ringshaped electrode which was absolutely necessary to be used in conventional methods, and hence it is no longer necessary to select material for assuring selectivity for complicated etchings. Accordingly, the instant embodiment can be readily applied to actually used processes.

In the instant embodiment, a field emission cold cathode is described to have two electrodes, specifically the gate electrode 13 and the focusing electrode 15 formed above the gate electrode 13 with the second insulating layer 14 sandwiched therebetween. However, it should be noted that there may be formed three or more electrodes in a field emission cold cathode, in which case the following steps are repeated: forming an insulating layer and an electrically conductive electrode layer on an already formed electrode layer, forming an opening or openings in the electrode layer, forming again an insulating layer and an electrically conductive electrode layer on an already formed electrode layer, and etching insulating layers with electrode layers deposited just thereon being used as a mask.

Figure 7G:
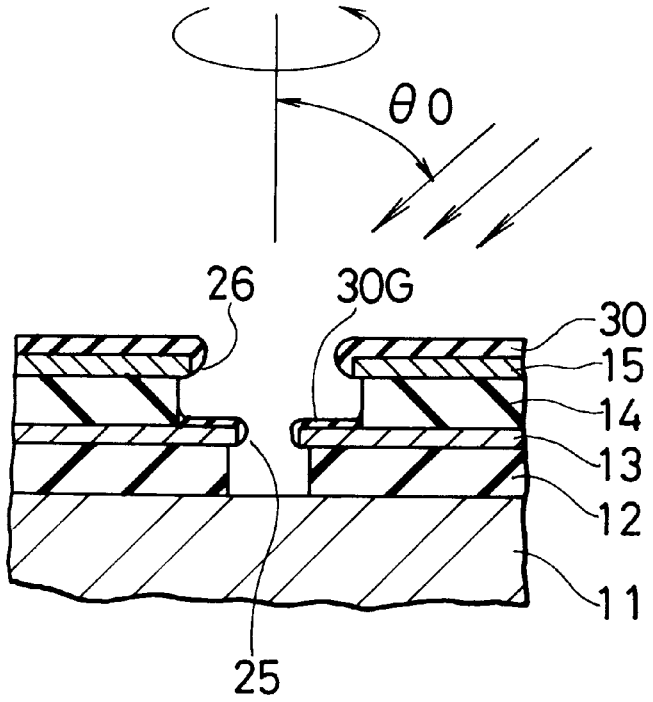

Referring back to FIG. 7F, an emitter electrode is formed on the silicon substrate 11 as follows. While the silicon substrate 11 is being rotated about an axis perpendicular to the substrate 11, aluminum oxide ($Al_2O_3$) is vacuum-evaporated obliquely to a resultant to thereby form a sacrifice layer 30, as illustrated in FIG. 7G. An incident angle θ0 of aluminum oxide evaporation is determined to be an angle with which evaporation of aluminum oxide is not interrupted by upper edges of an opening 26 formed in the focusing electrode 15 and aluminum oxide deposits on an inner sidewall of the gate electrode opening 25. In the instant embodiment, the sacrifice layer 30 is formed with the incident angle of about 50 degrees. As a result, as illustrated in FIG. 7G, the sacrifice layer 30 covers an upper surface of the focusing electrode 15 and an inner sidewall of the focusing electrode opening 26 therewith, and a sacrifice layer 30G covers an exposed upper surface of the gate electrode and an inner sidewall of the gate electrode opening 25.

It is possible to control a height of the emitter electrode 16 by varying a thickness of the sacrifice layer 30G. In the instant embodiment, the sacrifice layer is formed so as to have a thickness in the range of 0.2 $\mu$m to 0.5 $\mu$m both of which are values converted into thicknesses obtained when aluminum oxide is evaporated perpendicularly onto a substrate.

Figure 7H:
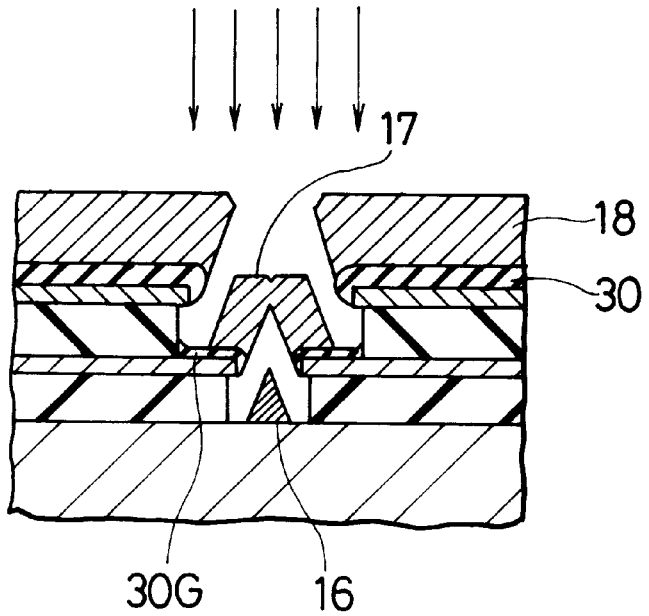
Figure 71:
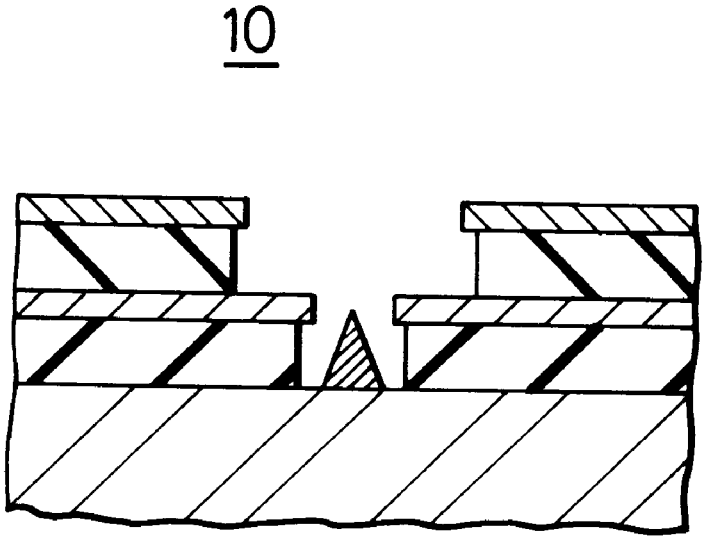

Then, as illustrated in FIG. 7H, molybdenum is vacuum-evaporated perpendicularly to the substrate 11 to thereby form the emitter electrode 16. In the formation of the emitter electrode 16, the sacrifice layer 30G acts as a mask for molybdenum particles. Simultaneously with the formation of the emitter electrode 16, an umbrella-shaped deposition 17 having a reverse V-shaped cross-section as illustrated in FIG. 7H is deposited on the sacrifice layer 30G, and a molybdenum layer 18 is formed on the focusing electrode 15.

Then, the sacrifice layers 30 and 30G are etched with phosphoric acid to thereby lift-off the umbrella-shaped deposition 17 and the molybdenum layer 18. Thus, there is completed the field emission cold cathode 10, as illustrated in FIG. 7I.

In accordance with the instant embodiment, as mentioned earlier, the sacrifice layer 30G formed on the gate electrode 13 and having an opening acts as a mask in the formation of the emitter electrode 16, thereby the emitter electrode 16 being located in the center of gate electrode opening 25. Thus, an electric field is symmetrically produced about a point of the emitter electrode 16, resulting in stable emission performance.

In addition, the mask for the formation of the emitter electrode 16 is located closer to the substrate 11 than the focusing electrode 15, namely the mask is formed on the gate electrode 13. It is thus possible to avoid deformation in shape of the emitter electrodes 16 located in the vicinity of an outer edge of a substrate, even if a large size substrate is used.

When a ratio of a diameter of the focusing electrode opening 26 to a diameter of the gate electrode opening 25 is relatively high (the ratio in the instant embodiment is 1.6/0.6=2.7), an opening of a mask has much unevenness due to much deposition of a sacrifice layer in a conventional process for forming a mask on the focusing electrode 15. In contrast, by forming a mask on the gate electrode 13 like the instant embodiment, it is possible to form a sacrifice layer to be relatively thin in thickness.

Thus, the sacrifice layer 30G forms a mask defining an opening having a shape quite approximate to a shape of the gate electrode opening 25, resulting in the emitter electrodes 16 having a shape to which a shape of the mask opening is projected can be formed uniformly in shape.

In addition, there is less dispersion in a diameter of the openings 25 and 26, thereby the emitter electrodes 16 have uniform height. Hence, each of the emitter electrodes can have uniform emission performance in an emitter array in which a plurality of the emitter electrodes 16 are arranged.

In the above mentioned embodiment, there is used an electrically conductive substrate 11. As an alternative, there may be used an insulating substrate such as glass and ceramic including an electrically conductive, thin film deposited on an upper surface thereof. There may be used a layered structure as a substrate which includes a resistive layer such as a silicon film into which phosphorus or boron is doped, and an electrically conductive film deposited on the resistive layer.

Though the instant embodiment employs sputtering and CVD for the formation of an insulating layer and an electrode, those skilled in the art will understand that other materials and methods may be employed. For instance, an insulating layer may be made of silicon nitride, aluminum dioxide and compounds thereof, and an electrically conductive layer may be made of refractory metal such as molybdenum and niobium, or silicide thereof. Vacuum evaporation and ion plating may be employed in place of sputtering and CVD.

In the instant embodiment, the gate electrode opening 25 has a diameter of 0.6 $\mu$m, and the second insulating layer has a thickness of 0.5 $\mu$m, and the focusing electrode opening 26 has a diameter of 1.6 $\mu$m. However, it should be noted that the diameters and thicknesses are not limited to those values.

In the instant embodiment, the electrode layers are made of tungsten and the insulating layers are made of silicon dioxide. However, the electrode and insulating layers may be made of other materials, unless materials to be selected have a practically sufficient etching selection ratio to the electrodes during etching of the first insulating layer 12.

Figure 8A:
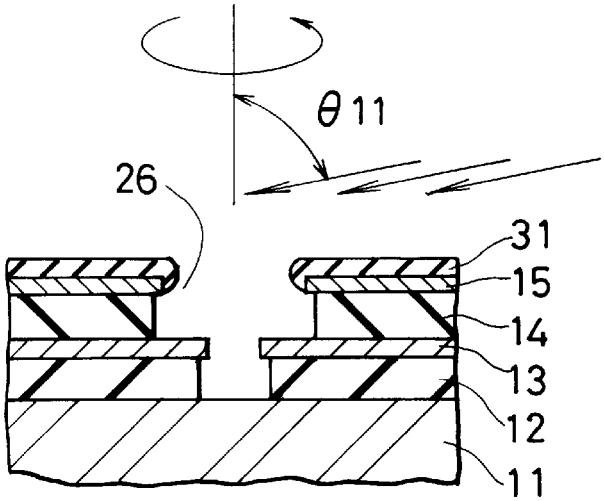
FIGS. 8A to 8C are cross-sectional views of a field emission cold cathode, illustrating respective steps of a method of fabricating the same in accordance with the second embodiment of the present invention.
Figure 8B:
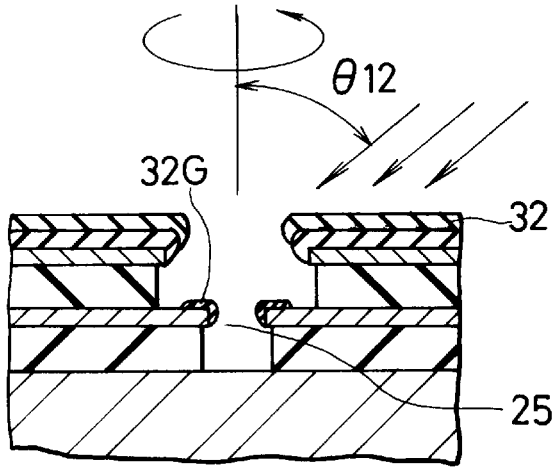
Figure 8C:
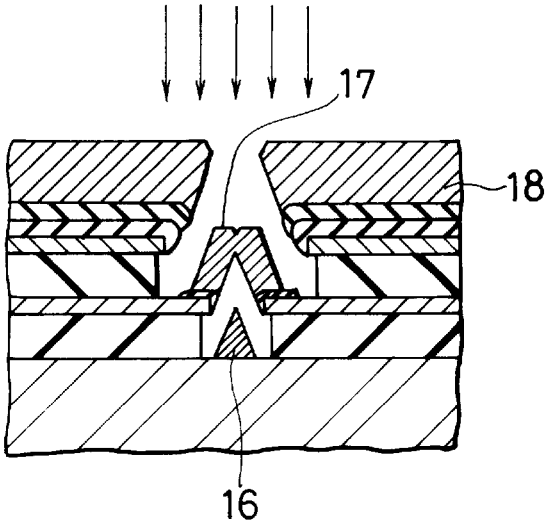

A method in accordance with the second embodiment is explained hereinbelow with reference to FIGS. 8A to 8C. FIGS. 8A to 8C illustrates steps to be carried out after a sacrifice layer is formed. The steps to be carried out prior to the formation of a sacrifice layer are the same as those of the first embodiment having been explained with reference to FIGS. 7A to 7F.

As illustrated in FIG. 8A, aluminum oxide ($Al_2O_3$) is vacuum-evaporated obliquely onto a resultant with the substrate 11 being rotated about an axis perpendicular to the substrate, to thereby form a first sacrifice layer 31 only on the focusing electrode 15. The first sacrifice layer 31 makes it easy to remove a molybdenum layer 18 which will be deposited on the focusing electrode 15 in a later step. An incident angle θ11 of aluminum oxide evaporation is determined to be an angle with which the first sacrifice layer 31 covers therewith an inner sidewall of the focusing electrode opening 26. In the second embodiment, the incident angle θ11 is determined to be about 80 degrees. The first sacrifice layer 31 is formed so as to have a thickness of about 0.02 $\mu$m or greater which is a value converted into a thickness obtained when aluminum oxide is evaporated perpendicularly onto a substrate.

The first sacrifice layer 31 is formed of aluminum oxide particles having been emitted with a relatively great angle θ11, so that the particles are deposited onto the focusing electrode 15 with a quite small angle made between the focusing electrode 15 and the particles. Hence, the first sacrifice layer 31 has a lower density than that of a layer formed on a substrate by emitting particles almost perpendicularly to the substrate, and hence has a higher etching rate than the above mentioned layer to common etching solution.

As illustrated in FIG. 8B, aluminum oxide ($Al_2O_3$) is vacuum-evaporated obliquely onto the first sacrifice layer 31 with an incident angle θ12 with the substrate 11 being rotated about an axis perpendicular to the substrate 11, to thereby form a second sacrifice layer 32. The incident angle θ12 of aluminum oxide evaporation is determined to be an angle with which evaporation of aluminum oxide is not interrupted by upper edges of the focusing electrode opening 26 covered with the first sacrifice layer 31 and aluminum oxide deposits also on an inner sidewall of the gate electrode opening 25. In the second embodiment, the incident angle θ12 is selected to be about 50 degrees. As a result, as illustrated in FIG. 8B, the second sacrifice layer 32 covers therewith the first sacrifice layer 31 formed on the focusing electrode 15, and a second sacrifice layer 32G covers therewith a distal end portion of the gate electrode 13 and an inner sidewall of the gate electrode opening 25. The second sacrifice layers 32 and 32G both define an opening therein.

Then, as illustrated in FIG. 8C, molybdenum is vacuum-evaporated perpendicularly to the substrate 11 to thereby form the emitter electrode 16. In the formation of the emitter electrode 16, the second sacrifice layer 32G formed on the gate electrode 13 acts as a mask for the molybdenum particles. Simultaneously with the formation of the emitter electrode 16, an umbrella-shaped deposition 17 having a reverse V-shaped cross-section is deposited on the second sacrifice layer 32G, and a molybdenum layer 18 is formed on the second sacrifice layer 32.

Then, the first and second sacrifice layers 31, 32 and 32G are etched with phosphoric acid to thereby lift-off the umbrella-shaped deposition 17 and the molybdenum layer 18. Thus, there is completed the field emission cold cathode 10, as illustrated in FIG. 7I.

In the etching of the sacrifice layers, the etching solution, which is phosphoric acid in the second embodiment, intrudes the sacrifice layers through side surfaces thereof, and moves traversely in the sacrifice layers as the etching solution etches the sacrifice layers. In particular, there exists a large area of the sacrifice layers on the focusing electrode 15, and hence it would take relatively long time to etch them. However, since the first sacrifice layer 31 having a low density is in advance formed on the focusing electrode 15 in the second embodiment, it is possible to remove a large area of the molybdenum layer 18 formed on the focusing electrode 15 in a short period of time.

On the gate electrode 13 is formed only the second sacrifice layer 32G having a relatively high density. Thus, it is possible to uniformize the emitter electrodes 16 in shape which are formed by using the second sacrifice layers 32G defining an opening therein above the substrate 11 where the emitter electrode 16 is to be formed.

In order to remove the umbrella-shaped deposition 17 formed on the gate electrode 13, it is necessary to etch the second sacrifice layer 32G having a relatively low etching rate. However, a traverse etching distance is merely a few microns ($\mu$m) at longest. Since a traverse etching distance on the focusing electrode 15 is a few millimeters, time for etching the second sacrifice layer 32G does not matter at all.

In accordance with the second embodiment, it is possible to remove unnecessary deposition such as the molybdenum layer 18 and the umbrella-shaped deposition 18 with certainty and in a short period of time in the lift-off step to be carried out after the molybdenum evaporation. The inventors conducted experiments about the incident angle θ11 of aluminum oxide evaporation for the formation of the first sacrifice layer 32, and confirmed that a period of time required for lift-off can be significantly shortened when the incident angle θ11 is 70 degrees or greater.

As mentioned earlier, the process disclosed in Japanese Unexamined Patent Publication No. 6-131970 employs the first and second sacrifice layers 91 and 92 (see FIGS. 5A to 5E). In this process, the first and second sacrifice layers 91 and 92 are deposited one on another. The first and second sacrifice layers 91 and 92 are used both as a mask for the formation of the emitter electrode 86. The process has to repeat evaporation of emitter material and lift-off twice. Hence, in order to accomplish the process, the second sacrifice layer 92 has to be selectively removable against the first sacrifice layer 91.

In contrast, the first and second sacrifice layers 31, 32 and 32G are not deposited one on another in the second embodiment. The first sacrifice layer 31 is formed for the purpose of carrying out lift-off in a shorter period of time, and does not act as a mask for the formation of the emitter electrode 16. Only the second sacrifice layer 32G acts as a mask. In addition, the first and second sacrifice layers 31, 32 and 32G are simultaneously etched at the first lift-off. Thus, those killed in the art would readily understand that the second embodiment is quite different in structure from the above mentioned Publication.

Figure 9A:
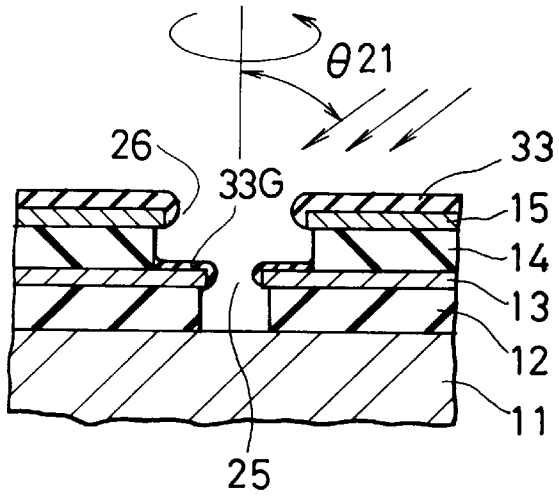
FIGS. 9A to 9C are cross-sectional views of a field emission cold cathode, illustrating respective steps of a method of fabricating the same in accordance with the third embodiment of the present invention.
Figure 9B:
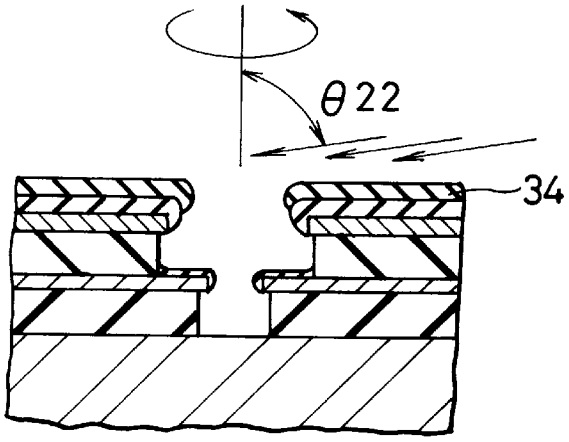
Figure 9C:
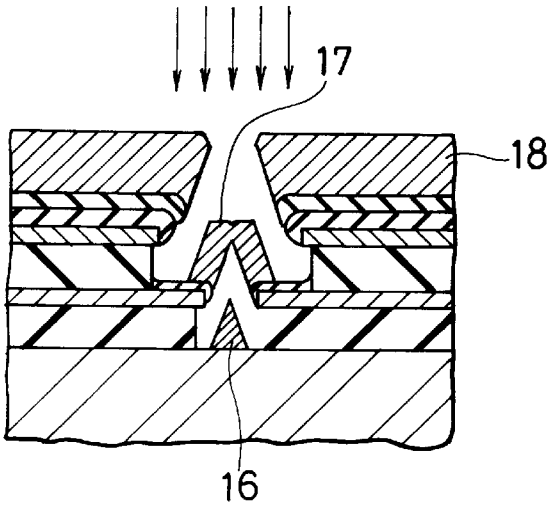

A method in accordance with the third embodiment is explained hereinbelow with reference to FIGS. 9A to 9C. FIGS. 9A to 9C illustrates steps to be carried out after a sacrifice layer is formed. The steps to be carried out prior to the formation of a sacrifice layer are the same as those of the first embodiment having been explained with reference to FIGS. 7A to 7F.

As illustrated in FIG. 9A, aluminum oxide ($Al_2O_3$) is vacuum-evaporated obliquely onto a resultant with the substrate 11 being rotated about an axis perpendicular to the substrate, to thereby form a first sacrifice layer 33. An incident angle θ21 of aluminum oxide evaporation is determined to be an angle with which evaporation of aluminum oxide is not interrupted by upper edges of the focusing electrode opening 26 and aluminum oxide deposits on both an exposed upper surface of the gate electrode 13 and an inner sidewall of the gate electrode opening 25. In the third embodiment, the incident angle θ21 is determined to be about 50 degrees. As a result, as illustrated in FIG. 9A, the first sacrifice layer 33 covers therewith an upper surface of the focusing electrode 15 and an inner sidewall of the focusing electrode opening 26, and a first sacrifice layer 33G covers therewith an exposed upper surface of the gate electrode 13 and an inner sidewall of the gate electrode opening 25.

Then, as illustrated in FIG. 9B, aluminum oxide ($Al_2O_3$) is vacuum-evaporated obliquely onto the first sacrifice layer 33 with an incident angle θ22 with the substrate 11 being rotated about an axis perpendicular to the substrate 11, to thereby form a second sacrifice layer 34 on the first sacrifice layer 33. As mentioned later, the second sacrifice layer 34 makes it easy to remove a molybdenum layer 18 deposited on the focusing electrode 15 during the formation of the emitter electrode 16.

The incident angle θ22 of aluminum oxide evaporation is determined to be an angle with which the second sacrifice layer 34 is formed covering the first sacrifice layer 33 therewith. In the third embodiment, the incident angle θ22 is determined to be about 80 degrees. The second sacrifice layer 34 is formed so as to have a thickness of about 0.02 $\mu$m or greater which is a value converted into a thickness obtained when aluminum oxide is evaporated perpendicularly onto a substrate.

The second sacrifice layer 34 is formed of aluminum oxide particles having been emitted with a relatively great angle θ22, so that the particles are deposited onto the first sacrifice layer 33 with a quite small angle made between the first sacrifice layer 33 and the particles. Hence, the second sacrifice layer 34 has a lower density than that of a layer formed on a substrate by emitting aluminum oxide particles almost perpendicularly to the substrate, and hence has a higher etching rate than the above mentioned layer to common etching solution.

Then, as illustrated in FIG. 9C, molybdenum is vacuum-evaporated perpendicularly to the substrate 11 to thereby form the emitter electrode 16 on the substrate 11. In the formation of the emitter electrode 16, the first sacrifice layer 33G formed on the gate electrode 13 acts as a mask for the molybdenum particles. Simultaneously with the formation of the emitter electrode 16, an umbrella-shaped deposition 17 having a reverse V-shaped cross-section is deposited on the first sacrifice layer 33G, and a molybdenum layer 18 is formed on the second sacrifice layer 34.

Then, the first and second sacrifice layers 33, 33G and 34 are etched with phosphoric acid to thereby lift-off the umbrella-shaped deposition 17 and the molybdenum layer 18. Thus, there is completed the field emission cold cathode 10, as illustrated in FIG. 7I.

Since the second sacrifice layer 34 is etched at a high speed, the molybdenum layer 18 formed on the focusing electrode 15 is lifted-off in a short period of time. Then, the first sacrifice layer 33 formed on the focusing electrode 15 is exposed outside, and hence exposed to etching solution. The first sacrifice layer 33 has a lower etching rate than that of the second sacrifice layer 34. However, what is necessary to do is to etch the first sacrifice layer 33 in a thickness-wise direction, and thus the etching of the first sacrifice layer 33 is completed in a short period of time.

In order to remove the umbrella-shaped deposition 17 formed on the gate electrode 13, it is necessary to etch the first sacrifice layer 33G having a relatively low etching rate. However, time for etching the first sacrifice layer 33G does not matter at all for the same reason as that of the second embodiment.

If the gate electrode opening 25 has a diameter almost equal to a diameter of the focusing electrode opening 26, the incident angle θ21 of aluminum oxide evaporation, which is determined to be an angle with which evaporation of aluminum oxide is not interrupted by upper edges of the focusing electrode opening 26 and aluminum oxide deposits on both an exposed upper surface of the gate electrode 13 and an inner sidewall of the gate electrode opening 25, has to be determined to be a small angle. That is, aluminum oxide has to be evaporated onto the substrate 11 almost perpendicularly, but making a meaningfully slight angle from a vertical axis. However, if the incident angle θ21 of aluminum oxide evaporation is determined to be small, aluminum oxide can deposit onto a lower portion of an inner sidewall of the first insulating layer 12. If the incident angle θ21 of aluminum oxide evaporation is determined to be quite small, aluminum oxide may deposit onto an upper surface of the substrate 11 on which the emitter electrode 16 is to be formed, resulting in deterioration in adhesion of the emitter electrode 16 to the substrate 11.

In the third embodiment, before the focusing electrode opening 26 is covered with the second sacrifice layer 34, there is formed the first sacrifice layer 33G which will act as a mask in the formation of the emitter electrode 16. Hence, an incident angle with which aluminum oxide is evaporated to the gate electrode opening 25 to thereby form a sacrifice layer which will act as a mask in the formation of the emitter electrode 16 can be determined to be greater in the third embodiment than that of the second embodiment. Specifically, the incident angle θ21 in the third embodiment (see FIG. 9A) can be determined to be greater than the incident angle θ12 in the second embodiment (see FIG. 8B). This brings an advantage that when the gate electrode opening 25 has a diameter almost equal to a diameter of the focusing electrode opening 26, or when the second insulating layer 14 is relatively thick, evaporated aluminum oxide particles do not reach the substrate 11 on which the emitter electrode 16 is to be formed, and hence conditions for the formation of the first sacrifice layer 33G can be extended.

Figure 10A:
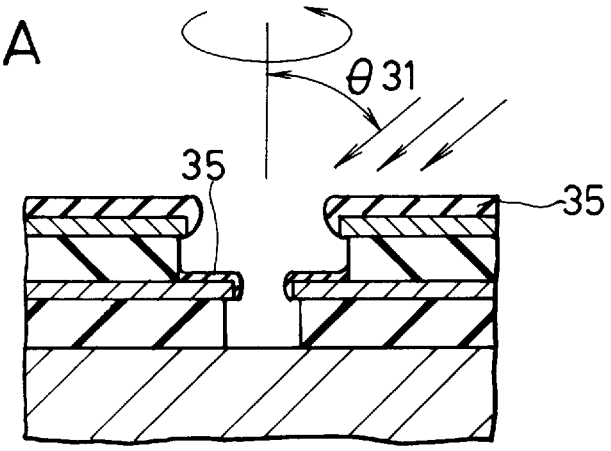
FIGS. 10A to 10C are cross-sectional views of a field emission cold cathode, illustrating respective steps of a method of fabricating the same in accordance with the fourth embodiment of the present invention.
Figure 10B:
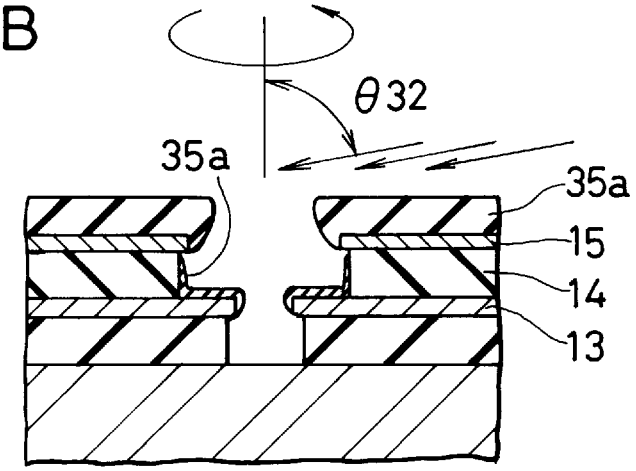
Figure 10C:
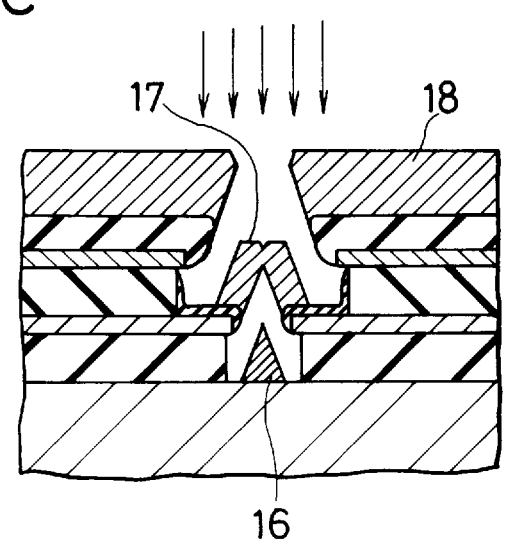

A method in accordance with the fourth embodiment is explained hereinbelow with reference to FIGS. 10A to 10C. FIGS. 10A to 10C illustrates steps to be carried out after a sacrifice layer is formed. The steps to be carried out prior to the formation of a sacrifice layer are the same as those of the first embodiment having been explained with reference to FIGS. 7A to 7F.

As illustrated in FIG. 10A, aluminum oxide ($Al_2O_3$) is vacuum-evaporated obliquely onto a resultant with the substrate 11 being rotated about an axis perpendicular to the substrate, to thereby form a first sacrifice layer 35. An incident angle θ31 of aluminum oxide evaporation is determined to be an angle with which evaporation of aluminum oxide is not interrupted by upper edges of the focusing electrode opening 26 and aluminum oxide deposits on both an exposed upper surface of the gate electrode 13 and an inner sidewall of the gate electrode opening 25. In the instant embodiment, the incident angle θ31 is determined to be about 50 degrees. As a result, as illustrated in FIG. 10A, the first sacrifice layer 35 covers therewith an upper surface of the focusing electrode 15 and an inner sidewall of the focusing electrode opening 26, and further covers therewith an exposed upper surface of the gate electrode 13 and an inner sidewall of the gate electrode opening 25.

Then, as illustrated in FIG. 10B, an incident angle is varied continuously or in stages from the angle θ31 to an angle θ32 with the substrate 11 being rotated and aluminum oxide being continuously vacuum-evaporated obliquely onto a resultant. Herein, the incident angle θ32 is an angle with which aluminum oxide does not reach the gate electrode opening 25, but covers therewith the first sacrifice layer 35 having already been formed on the focusing electrode 15. In the instant embodiment, the incident angle θ32 is determined to be about 80 degrees. By continuing evaporation of aluminum oxide onto a resultant with the incident angle θ32, as illustrated in FIG. 10B, a second sacrifice layer 35*a* covers therewith the first sacrifice layer 35 formed on the focusing electrode 15 and an inner sidewall of the focusing electrode opening 26, and further covers therewith an inner sidewall of the second insulating layer 14.

Then, as illustrated in FIG. 10C, molybdenum is vacuum-evaporated perpendicularly to the substrate 11 to thereby form the emitter electrode 16 on the substrate 11. In the formation of the emitter electrode 16, the first sacrifice layer 35 formed on the gate electrode 13 acts as a mask for the molybdenum particles. Simultaneously with the formation of the emitter electrode 16, an umbrella-shaped deposition 17 having reverse V-shaped cross-section is deposited on the first sacrifice layer 35, and a molybdenum layer 18 is formed on the second sacrifice layer 35*a*.

Then, the first and second sacrifice layers 35 and 35*a* are etched with phosphoric acid to thereby lift-off the umbrella-shaped deposition 17 and the molybdenum layer 18. Thus, there is completed the field emission cold cathode 10, as illustrated in FIG. 7I.

In FIGS. 10A and 10B, it seems that the substrate 11 is fixed, and an evaporation source (not illustrated) moves In actual vacuum-evaporation, an evaporation source is disposed below a film formation device since evaporation material has to be molten in the evaporation source, and the substrate is supported by a substrate holder disposed above the evaporation source. The substrate holder is designed to rotate about an axis perpendicular to the substrate, and a device for rotating the substrate holder can be inclined with respect to the axis. Thus, the incident angle of aluminum oxide evaporation can be adjusted in accordance with an inclination angle of the substrate holder, and hence the incident angle of aluminum oxide evaporation can be varied even while aluminum oxide is being evaporated onto a substrate.

In the above mentioned second and third embodiments, aluminum oxide evaporation steps have to be carried out twice for the formation of the sacrifice layers. In contrast, in accordance with the above mentioned fourth embodiment, the sacrifice layer can be formed by carrying out evaporation only once, resulting in improvement in throughput.

In the fourth embodiment, since the incident angle is continuously or intermittently varied, the sacrifice layer 35*a* is formed on an inner sidewall of the second insulating layer 14, as illustrated in FIG. 10B. Hence, even if molybdenum evaporation particles dispersed by residual gas molecules during the formation of the emitter electrode 16 approach an inner sidewall of the second insulating layer 14, those particles deposit on the sacrifice layer 35*a*. Such evaporation particles as deposited on the sacrifice layer 35*a* can be removed in the lift-off step, and thus insulation characteristic between the gate electrode 13 and the focusing electrode 15 is not deteriorated.

In the above mentioned fourth embodiment, the incident angle for the formation of the second sacrifice layer 35*a* is increasingly varied, specifically varied from 50 degrees to 80 degrees. To the contrary, the incident angle may be decreasingly varied, for instance, from 80 degrees to 50 degrees. As an alternative, the incident angle may be varied reciprocatingly between two predetermined angles.

A method in accordance with the fifth embodiment of the present invention is explained hereinbelow with reference to FIGS. 11A to 11G.

Figure 11A:
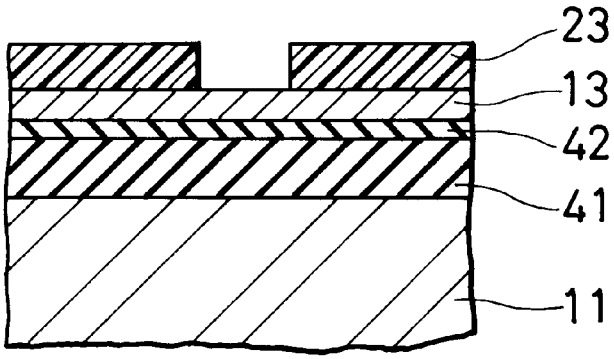
FIGS. 11A to 11G are cross-sectional views of a field emission cold cathode, illustrating respective steps of a method of fabricating the same in accordance with the fifth embodiment of the present invention.

As illustrated in FIG. 11A, a silicon dioxide ($SiO_2$) film 41 as the first insulating layer is formed on a silicon substrate 11 by an about 0.4 μm thickness. Then, a silicon nitride ($Si_3N_4$) film 42 as the second insulating layer is formed on the first insulating layer 41 by an about 0.1 μm thickness by CVD. Then, a tungsten (W) film as the electrically conductive gate electrode 13 is deposited over the second insulating film by an about 0.2 μm by sputtering. Then, a photoresist layer 23 is deposited over the gate electrode 13, and is formed by photolithography with a plurality of circular openings (only one of them is illustrated in FIG. 11A) each having a diameter of about 0.6 μm.

Figure 11B:
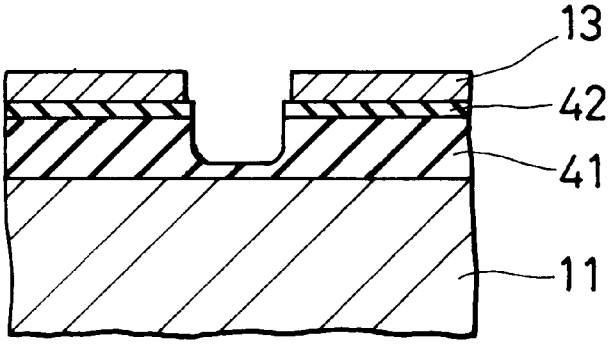
Figure 11C:
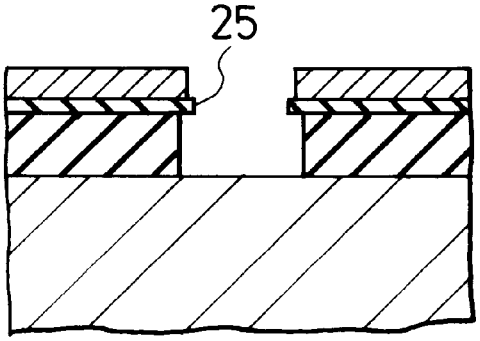

Then, the gate electrode 13, the second insulating layer 42 and the first insulating layer 41 are etched by RIE with the patterned photoresist layer 23 being used as a mask so that the first insulating layer 41 remains only by an about 0.1 μm thickness, as illustrated in FIG. 11B. Thereafter, the first insulating layer 41 is further etched with buffered hydrofluoric acid (BHF) to thereby cause the second insulating layer 42 to horizontally project beyond the first insulating layer 41 and the gate electrode 13, as illustrated in FIG. 11C. Then, the photoresist layer 23 is removed.

Anisotropy and selection ratio in etching against material to be etched are varied in accordance with etching gas and conditions for RIE. Thus, by suitably selecting etching gas and conditions for RIE, it is possible to have a configuration where the second insulating layer 42 projects beyond the first insulating layer 41 and the gate electrode 13, as illustrated in FIG. 11C.

Figure 11D:
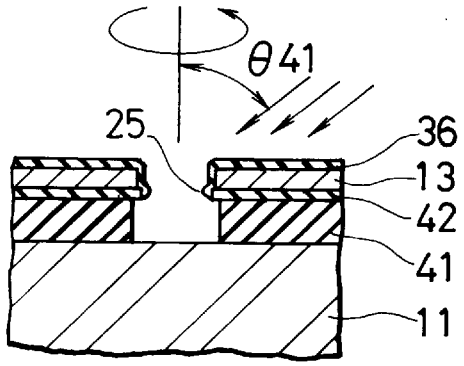

Then, as illustrated in FIG. 11D, aluminum oxide ($Al_2O_3$) is vacuum-evaporated obliquely to a resultant incident with an incident angle θ41 to thereby form a first sacrifice layer 36 with the substrate 11 being rotated about an axis perpendicular to the substrate 11. The incident angle θ41 of aluminum oxide evaporation is determined to be an angle with which evaporated aluminum oxide particles are partially interrupted by upper edges of the gate electrode opening 25, but can reach lower edges of an opening defined by the second insulating layer 42, at opposite side to the upper edges of the gate electrode opening 25. In the instant embodiment, the incident angle θ41 is determined to be about 60 degrees. As a result, as illustrated in FIG. 11D, the first sacrifice layer 36 covers an upper surface and an inner sidewall of the gate electrode 13, an upper surface of the projected portion of the second insulating layer 42, and an inner sidewall of an opening defined by the second insulating layer 42. In the instant embodiment, the first sacrifice layer 36 is formed so as to have a thickness in the range of about 0.05 μm to about 0.1 μm both of which are values converted into thicknesses obtained when aluminum oxide is evaporated perpendicularly onto a substrate. Thus, a stepped portion between the second insulating layer 42 and the gate electrode 13 is covered with the first sacrifice layer 36.

Figure 11E:
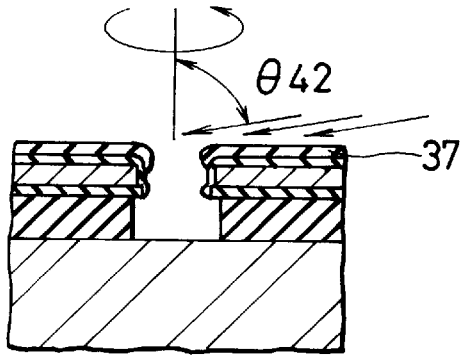

Then, as illustrated in FIG. 11E, aluminum oxide is evaporated with the incident angle θ42 onto the first sacrifice layer 36 to thereby form a second sacrifice layer 37 on the first sacrifice layer 36 so that an opening defined by the second sacrifice layer 37 has a smaller inner diameter than that of an opening defined by he first sacrifice layer 36 deposited on an inner sidewall of an opening defined by the second insulating layer 42. In the fifth embodiment, the incident angle θ42 is determined to be about 80 degrees.

Figure 11F:
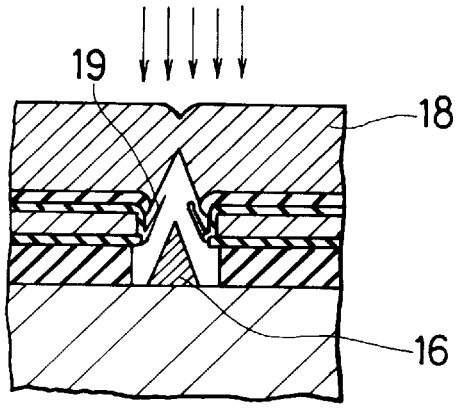

Then, as illustrated in FIG. 11F, molybdenum is vacuum-evaporated perpendicularly to the substrate 11 to thereby form the emitter electrode 16. In the formation of the emitter electrode 16, the second sacrifice layer 37 formed above the gate electrode 13 acts as a mask for molybdenum particles. In practical fabrication, since there may be dispersion in shape of openings formed in the gate electrode 13 and the second insulating layer 42 and also in shape of the formed sacrifice layers, the first sacrifice layer 36 formed on the second insulating layer 42 might have a projection inwardly extending beyond an inner diameter of an opening defined by the second sacrifice layer 37. Thus, molybdenum particles deposits also on such a projection of the second insulating layer 42 to thereby form an unnecessary deposition 19. In addition, similarly to the previously mentioned embodiments, simultaneously with the formation of the emitter electrode 16, a molybdenum layer 18 is formed on the second sacrifice layer 37.

Figure 11G:
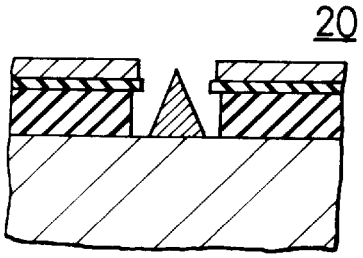

Then, the first and second sacrifice layers 36 and 37 are etched with phosphoric acid to thereby lift-off the molybdenum layer 18. Thus, there is completed a field emission cold cathode 20, as illustrated in FIG. 11G. The unnecessary projection 19 is also removed when the first sacrifice layer 36 formed on the second insulating layer 42 is etched out.

In accordance with the above mentioned fifth embodiment, even if a cavity has a stepped portion at its inner sidewall or there is dispersion in shape of the gate electrode and the sacrifice layers with the result of the formation of unnecessary deposition, it is possible to remove such an unnecessary deposition in a lift-off step. Thus, a field emission cold cathode is not influenced in shape.

In the fifth embodiment, the first and second sacrifice layers 36 and 37 are separately formed, but it should be noted that they may be formed by continuous evaporation of aluminum oxide with an incident angle of evaporation being continuously varied in the same way as the fourth embodiment.

The present invention explained so far with reference to the preferred embodiments provides various advantages as follows.

The first advantage is that a field emission cold cathode having a focusing electrode is equalized to a field emission cold cathode having no focusing electrode with respect to an inclination of emitter electrodes disposed near an outer edge of a substrate, and misalignment of an emitter electrode with a gate electrode opening. This is because an opening of a gate electrode located closer to a substrate on which an emitter electrode is formed than a focusing electrode acts as a mask for the formation of an emitter electrode, and hence misalignment for fluctuation in an incident angle of evaporation of emitter material can be made smaller in a horizontal direction.

The second advantage is high designability in a diameter of an opening formed in the focusing electrode and a distance from the gate electrode to the focusing electrode which distance corresponds to a thickness of the second insulating layer, and small dispersion in shape of the emitter electrodes. This advantage is brought by the fact that since the gate electrode opening is used as a mask for the formation of the emitter electrode, it is scarcely necessary to vary a thickness of the sacrifice layers, even when a diameter of the focusing electrode opening is made greater.

The third advantage is that misalignment of the emitter electrodes with the gate electrode opening can be made smaller. This advantage is brought by the fact that since the gate electrode opening is used as a mask for the formation of the emitter electrode, the location of the emitter electrode is dependent on the gate electrode, even if the gate electrode is in misalignment with the focusing electrode opening.

The fourth advantage is that a process for the formation of emitter electrodes is made simpler. This is because that it is no longer necessary to use a ring-shaped mask layer which was necessary to use in the conventional methods. Hence, the process can be shortened, and it is no longer necessary to select material of which a ring-shaped mask layer is made, taking various conditions into consideration. In addition, a lift-off step can be accomplished in a shorter period of time by forming a sacrifice layer of a two-layered structure.

The fifth advantage is that it is possible to remove unnecessary deposition deposited on the gate electrode opening. The reason is as follows. In a field emission cold cathode having a focusing electrode, since the gate electrode opening is used as a mask for the formation of an emitter electrode, a sacrifice layer covers the gate electrode opening therewith. In a field emission cold cathode having no focusing electrode, a sacrifice layer is in advance formed onto a region where unnecessary deposition may be deposited. In both cases, the formation of a sacrifice layer makes it easy to remove unnecessary deposition deposited on the gate electrode opening.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 8-131135 filed on Apr. 26, 1996 including specification, claims, drawings and summary is incorporated herein by reference in its entirety.

What is claimed is:

1. A method of fabricating a field emission cold cathode, comprising the steps, in sequence, of:

(a) forming a first insulating layer on a substrate and further forming a first electrode layer on said first insulating layer;

(b) forming at least one opening in said first electrode layer;

(c) forming a second insulating layer on said first electrode layer and further forming a second electrode layer on said second insulating layer;

(d) forming at least one opening in said second electrode layer;

(e) forming a cavity extending from an uppermost electrode layer to said substrate; and (f) forming a first sacrifice layer on said second electrode layer surrounding said at least one opening in the second electrode layer and on an exposed portion of the first electrode layer;

(g) forming an emitter electrode on said substrate in said first insulating and electrode layers.

2. The method as set forth in claim 1, wherein said cavity is formed in said step (c) by etching said insulating layers with said electrode layers lying on said insulating layers being used as masks.

3. The method as set forth in claim 1, wherein an opening formed in an electrode layer has a larger area than an area of an opening formed in electrode layers located therebelow.

4. A method of fabricating a field emission cold cathode comprising the steps, in sequence, of:

(a) forming a first insulating layer on a substrate and further forming a first electrode layer on said first insulating layer;

(b) forming at least one opening in said first electrode layer;

(c) forming a second insulating layer on said first electrode layer and further forming a second electrode layer on said second insulating layer;

(d) forming at least one opening in said second electrode layer;

(e) forming a cavity extending from an uppermost electrode layer to said substrate;

(f) forming a first sacrifice layer around an opening of said electrode layer including on an exposed portion of said first electrode layer; and (g) forming an emitter electrode on said substrate with said first sacrifice layer formed on said first electrode layer being used as a mask.

5. The method as set forth in claim 4, wherein said first sacrifice layer is formed around an opening of said first electrode layer.

6. The method as set forth in claim 5, wherein said first sacrifice layer is formed in said step (f) by oblique evaporation of source material, said source material being deposited around said opening with an incident angle defined so that evaporation of source material is not interrupted by edges of an opening formed in an uppermost layer and source material deposits on an electrode layer which will act as a mask when an emitter is formed on said substrate.

7. The method as set forth in claim 4, wherein said cavity is formed in said step (c), at least in part, by etching said electrode layers with reactive ion etching (RIE) and by etching said insulating layers with buffered hydrofluoric acid (BHF).

8. A method of fabricating a field emission cold cathode, comprising the steps, in sequence, of:

(a) forming a first insulating layer on a substrate and further forming a first electrode layer on said first insulating layer;

(b) forming at least one first opening in said first electrode layer;

(c) forming a second insulating layer on said first electrode layer and further forming a second electrode layer of said second insulating layer;

(d) forming at least one second opening in said second electrode layer;

(e) forming a cavity extending from an uppermost electrode layer to said substrate;

(f) forming a first sacrifice layer around a first opening of the first electrode layer;

(g) forming a second sacrifice layer around a second opening of the second electrode layer; and (h) forming an emitter electrode on said substrate with said second sacrifice layer being used as a mask.

9. The method as set forth in claim 8, wherein said first sacrifice layer is formed on an uppermost electrode layer.

10. The method as set forth in claim 8, wherein said first sacrifice layer is formed by oblique evaporation of source material, said source material being deposited with a first incident angle defined so that obliquely evaporated source material covers therewith an inner sidewall of an opening formed in said uppermost electrode layer.

11. The method as set forth in claim 8, wherein said second sacrifice layer is formed by oblique evaporation of source material, said source material being deposited with a second incident angle defined so that evaporation of source material is not interrupted by edges of an opening formed in an uppermost layer and source material deposits on an inner sidewall of an opening formed in an electrode layer located below said uppermost layer.

12. The method as set forth in claim 8, wherein the second sacrifice layer has a greater density than a density of said first sacrifice layer.

13. The method as set forth in claim 8, wherein said second sacrifice layer is formed by oblique evaporation of source material, said source material being deposited with a second incident angle defined so that said second sacrifice layer covers said first sacrifice layer therewith.

14. The method as set forth in claim 8, wherein said first sacrifice layer is further formed in said step (f) on an upper most layer, and further wherein the step of forming the second sacrifice layer comprises forming the second sacrifice layer on said first sacrifice layer.

15. The method as set forth in claim 8, wherein said first and second sacrifices layers are formed with different incident angles in oblique evaporation of source material.

16. The method as set forth in claim 8, wherein said first and second sacrifices layers are formed with incident angles for oblique evaporation of source material being continuously varied.

17. The method as set forth in claim 8, wherein said incident angle is increasing from a first incident angle for forming said first sacrifice layer to a second incident angle for forming said second sacrifice layer.

18. The method as set forth in claim 8, wherein said incident angle is decreasing from a first incident angle for forming said first sacrifice layer to a second incident angle for forming said second sacrifice layer.

19. The method as set forth in claim 8, wherein said incident angle is varied reciprocatingly between first and second predetermined angles.

20. The method as set forth in claim 8, wherein said first and second sacrifices layers are formed with incident angles in oblique evaporation of source material being varied in stages.

21. The method as set forth in claim 8, wherein said second sacrifice layer has a portion formed by oblique evaporation of source material with an incident angle of 70 degrees or greater with respect to an axis perpendicular to said substrate.

22. A method of fabricating a field emission cold cathode, comprising the steps, in sequence, of:

(a) forming a first insulating layer on a substrate and further forming first electrode layer on said first insulating layer;

(b) forming at least one first opening in said first electrode layer;

(c) forming a second insulating layer on said first electrode layer and further forming a second electrode layer on said second insulating layer;

(d) forming at least one second opening in said second electrode layer;

(e) forming a cavity extending from an uppermost electrode layer to said substrate;

(f) depositing a first sacrifice layer around said at least one second opening with a first incident angle;

(g) depositing a second sacrifice layer around said at least one first opening with a second incident angle less than said first incident angle;

(h) forming an emitter electrode on said substrate with said second sacrifice layer being used as a mask.

23. The method as set forth in claim 22, wherein said second sacrifice layer is formed only on an uppermost electrode layer.

24. The method as set forth in claim 22, wherein said second sacrifice layer is formed by oblique evaporation of source material, said source material being deposited with a first incident angle defined so that obliquely evaporated source material is not interrupted by an opening of an uppermost electrode layer and covers therewith an inner sidewall of an opening formed in said first electrode layer.

25. The method as set forth in claim 22, wherein said first sacrifice layer is formed by oblique evaporation of source material, said source material being deposited with a second incident angle defined so that evaporation of source material is not interrupted by edges of an opening formed in an uppermost layer and source material deposits on an inner sidewall of an opening formed in an electrode layer located below said uppermost layer.

26. The method as set forth in claim 22, wherein the first sacrifice layer has a greater density than a density of said second sacrifice layer.

27. The method as set forth in claim 22, wherein said first sacrifice layer is formed by oblique evaporation of source material, said source material being deposited with a second incident angle defined so that said second sacrifice layer covers said second sacrifice layer therewith.

28. The method as set forth in claim 22, wherein said first and second sacrifices layers are formed with different incident angles in oblique evaporation of source material.

29. The method as set forth in claim 22, wherein said first and second sacrifices layers are formed with incident angles for oblique evaporation of source material being continuously varied.

30. The method as set forth in claim 29, wherein said incident angle is increasing from a first incident angle for forming said second sacrifice layer to a second incident angle for forming said first sacrifice layer.

31. The method as set forth in claim 29, wherein said incident angle is decreasing from a first incident angle for forming said second sacrifice layer to a second incident angle for forming said first sacrifice layer.

32. The method as set forth in claim 29, wherein said incident angle is varied reciprocatingly between first and second predetermined angles.

33. The method as set forth in claim 22, wherein said first and second sacrifices layers are formed with incident angles in oblique evaporation of source material being varied in stages.

34. The method as set forth in claim 22, wherein said first sacrifice layer has a portion formed by oblique evaporation of source material with an incident angle of 70 degrees or greater with respect to an axis perpendicular to said substrate.

35. A method of fabricating a field emission cold cathode, comprising the steps, in sequence, of:

(a) forming a first insulating layer on a substrate and further forming a second insulating layer on said first insulating layer;

(b) forming an electrode layer on said second insulating layer;

(c) forming a cavity through said electrode layer and said first and second insulating layers so that said second insulating layer projects inwardly of said cavity beyond said first insulating layer and said electrode layer;

(d) forming a first sacrifice layer covering said electrode layer and a projecting portion of said second insulating layer therewith by depositing sacrifice layer material at a first angle;

(e) forming a second sacrifice layer only above said electrode layer by depositing sacrifice layer material at a second angle; and (f) forming an emitter electrode on said substrate with said second sacrifice layer acting as a mask.

36. A method of forming an emitter on a substrate, comprising the steps of:

(a) depositing a first sacrifice layer around a second opening formed in a second electrode layer with a first incident angle, a first insulating layer, a first electrode layer, a second insulating layer, and said second electrode layer being formed on said substrate in this order;

(b) depositing a second sacrifice layer around a first opening formed in said first electrode layer, with a second incident angle less than said first incident angle, and (c) forming an emitter electrode on said substrate with said second sacrifice layer being used as a mask.

37. A method of forming an emitter on a substrate, comprising the steps of:

(a) forming a first sacrifice layer covering both an electrode layer formed above a substrate with an insulating layer being sandwiched therebetween, and a projecting portion of said insulating layer therewith by depositing sacrifice layer material at a first angle;

(b) forming a second sacrifice layer only above said electrode layer by depositing sacrifice layer material at a second angle; and (c) forming an emitter electrode on said substrate with said second sacrifice layer being used as a mask.

38. The method as set forth in claim 1, wherein said step (g) includes the steps of:

(g1) depositing emitter electrode material on said first sacrifice layer to thereby form said emitter electrode with said opening being used as a mask; and (g2) etching said first sacrifice layer in selected areas to thereby lift-off unnecessary portions of said emitter electrode material.

* * * * *